US011318068B2

(12) United States Patent
Liu et al.

(10) Patent No.: US 11,318,068 B2
(45) Date of Patent: May 3, 2022

(54) DISSOLVING AND DISPENSING UNIT, DISSOLVING AND DISPENSING SYSTEM, AND DISSOLVING AND DISPENSING METHOD

(71) Applicant: Shanghai Chisu Pharmaceutical Technology Co., Ltd., Shanghai (CN)

(72) Inventors: Weiqiang Liu, Shanghai (CN); Xuan Chen, Shanghai (CN); Lawrence Shiang Chao, Shanghai (CN)

(73) Assignee: Shanghai Chisu Pharmaceutical Technology Co., Ltd., Shanghai (CN)

( * ) Notice: Subject to any disclaimer, the term of this patent is extended or adjusted under 35 U.S.C. 154(b) by 461 days.

(21) Appl. No.: 16/463,029

(22) PCT Filed: Nov. 22, 2017

(86) PCT No.: PCT/CN2017/112374

§ 371 (c)(1),
(2) Date: May 22, 2019

(87) PCT Pub. No.: WO2018/095331

PCT Pub. Date: May 31, 2018

(65) Prior Publication Data

US 2019/0274926 A1 Sep. 12, 2019

(30) Foreign Application Priority Data

Nov. 24, 2016 (CN) ..... 201611042102.5
Jul. 20, 2017 (CN) ..... 201720883852.9

(51) Int. Cl.

| | |
|---|---|
| ***A61J 1/20*** | (2006.01) |
| ***B01F 21/00*** | (2022.01) |
| ***B01F 31/20*** | (2022.01) |
| ***B01F 33/84*** | (2022.01) |
| ***B01F 35/71*** | (2022.01) |
| *B01F 101/22* | (2022.01) |

(52) U.S. Cl.
CPC ..... *A61J 1/2013* (2015.05); *A61J 1/20* (2013.01); *B01F 21/30* (2022.01); *B01F 31/20* (2022.01);
(Continued)

(58) Field of Classification Search
CPC ..... A61J 1/201; A61J 1/2013
(Continued)

(56) References Cited

U.S. PATENT DOCUMENTS 2,309,302 A * 1/1943 Butler ..... A61M 1/02 604/412
2011/0004143 A1* 1/2011 Beiriger ..... A61M 5/162 604/6.11
(Continued)

FOREIGN PATENT DOCUMENTS

CN 203524998 U 4/2014
CN 203598225 U 5/2014
(Continued)

OTHER PUBLICATIONS

Feb. 6, 2018, International Search Report of PCT/CN2017/112374.
(Continued)

*Primary Examiner* — David L Sorkin
(74) *Attorney, Agent, or Firm* — Banner & Witcoff, Ltd.

(57) ABSTRACT

A dissolving and mixing unit for automatically dissolving and mixing medicines includes: a support; a dissolving and mixing device mounted on the support and including two piercer bases and at least one dissolving and mixing channel, wherein each dissolving and mixing channel includes two piercers and an elastic infusion hose connecting the two piercers, and the two piercers of each dissolving and mixing channel are mounted on the two piercer bases respectively; a peristaltic pump mounted on the support and configured to squeeze the elastic infusion hose; first and second bottle-
(Continued)

containing modules mounted on the support and configured to hold first and second medicine containers respectively; and a movement mechanism configured to drive at least one of the first bottle-containing module and one piercer base to move, and configured to drive at least one of the second bottle-containing module and the other piercer base to move.

19 Claims, 17 Drawing Sheets

(52) U.S. Cl.
CPC ..... *B01F 33/84* (2022.01); *B01F 35/7137* (2022.01); *B01F 35/717611* (2022.01); *B01F 31/201* (2022.01); *B01F 2101/22* (2022.01)

(58) Field of Classification Search
USPC ..... 604/412, 416
See application file for complete search history.

(56) References Cited

U.S. PATENT DOCUMENTS

| | | | | |
|---|---|---|---|---|
| 2011/0315269 | A1 | 12/2011 | Williamson et al. | |
| 2012/0029464 | A1* | 2/2012 | Kragelund ..... | A61J 1/2089 604/414 |

FOREIGN PATENT DOCUMENTS

| | | | |
|---|---|---|---|
| CN | 204428435 | U | 7/2015 |
| CN | 105708694 | A | 6/2016 |
| CN | 106038288 | A | 10/2016 |
| CN | 205612737 | U | 10/2016 |
| CN | 106473924 | A | 3/2017 |
| CN | 206508252 | U | 9/2017 |
| JP | 2013184027 | A | 9/2013 |
| WO | 2018095331 | A1 | 5/2018 |

OTHER PUBLICATIONS

Feb. 13, 2020, Australian Examination Report of Application No. 2017366411.
Feb. 13, 2018, CN Office Action of Application No. 201611042102.5.
Oct. 16, 2018, CN Office Action of Application No. 201611042102.5.
Aug. 27, 2019, EP Search Report of Application No. 17873542.9-1113.
Nov. 8, 2019, New Zealand Examination Report of Application No. 753750.

* cited by examiner

DISSOLVING AND DISPENSING UNIT, DISSOLVING AND DISPENSING SYSTEM, AND DISSOLVING AND DISPENSING METHOD

CROSS-REFERENCE TO RELATED APPLICATIONS

The present application is a U.S. National Phase Entry of International PCT Application No. PCT/CN2017/112374 having an international filing date of Nov. 22, 2017, which claims priorities to Chinese patent application No. 201611042102.5, entitled "Dissolving and Mixing Unit for Automatic Dissolving and Mixing System, and Dissolving and Mixing Method Performed by Dissolving and Mixing Unit for Automatic Dissolving and Mixing System", filed to the CNIPA on Nov. 24, 2016, and Chinese patent application No. 201720883852.9, entitled "Dissolving and Mixing Unit", filed to the CNIPA on Jul. 20, 2017. The present application claims priority and the benefit of the above-identified applications and the above-identified applications are incorporated by reference herein in their entirety.

TECHNICAL FIELD

The present application relates to, but is not limited to, the field of methods and apparatuses for dissolving and mixing medicines, particularly to a dissolving and mixing unit that automatically dissolves and mixes medicines, a dissolving and mixing system comprising the dissolving and mixing unit, and a dissolving and mixing method for dissolving and mixing medicines by using the dissolving and mixing unit.

BACKGROUND

At present, there are mainly two modes in which hospitals prepare medicines for intravenous infusion. One mode is performing centralized preparation in the Pharmacy Intravenous Admixture Services (PIVAS), and the other mode is performing temporary preparation in an emergency room or a ward. However, in most cases, both preparation modes are operated manually by medical staff, in the process of preparation, are not able to continuously prepare, efficiency is low, speed is slow and labor intensity is high. In addition, when preparing medicines bottled in vials, it is easy to cause leakage of liquid and particle contamination due to multiple piercings of rubber stoppers of vials and infusion containers. When preparing cytotoxic drugs, chemotherapy drugs, drugs that are prone to allergies, highly active medicines and the like, the rubber stoppers of the vials and the infusion containers are pierced multiple times, which can easily cause spatter and volatilization of the drugs, causing slight but long-term injury to dispensers, and may bring irreversible consequences. When the rubber stoppers of the vials and the infusion containers are pierced multiple times, the needles may be contaminated by microorganisms as the needles are exposed to a non-sterile environment, and the contaminated microorganisms may cause secondary microorganism contaminations during the infusion process due to multiple piercings. Moreover, the manual operation is easily affected by the mental state and dispensing speed of the operating staff. Therefore, there is a need for medical institutions to innovate the dispensing mode, so as to achieve an automatic, high-efficiency and contamination-free dispensing mode.

SUMMARY

The following is an overview of the subject matters described in detail herein. The summary is not intended to limit the protection scope of the claims.

The present application provides a dissolving and mixing unit, a dissolving and mixing system and a dissolving and mixing method capable of realizing the automatic dissolving and mixing of medicines.

In order to achieve the above purposes, the present application adopts the following technical schemes.

A dissolving and mixing unit for automatically dissolving and mixing medicines includes:

a support;

a dissolving and mixing device, which is mounted on the support and includes two piercer bases and at least one dissolving and mixing channel, each dissolving and mixing channel including two piercers and an elastic infusion hose connecting the two piercers, and the two piercers of each dissolving and mixing channel being mounted on the two piercer bases respectively;

a peristaltic pump, which is mounted on the support and configured to squeeze the elastic infusion hose;

a first bottle-containing module, which is mounted on the support and configured to secure a first medicine container;

a second bottle-containing module, which is mounted on the support and configured to secure a second medicine container; and a movement mechanism, which is configured to drive at least one of the first bottle-containing module and one piercer base to move so that the piercer on the piercer base pierces the first medicine container or separates from the first medicine container; and configured to drive at least one of the second bottle-containing module and the other piercer base to move, so that the piercer on the other piercer base pierces the second medicine container or separates from the second medicine container.

A dissolving and mixing system includes at least one dissolving and mixing unit described herein.

A dissolving and mixing method includes the following steps:

holding a first medicine container and a second medicine container in a first bottle-containing module and a second bottle-containing module, respectively;

driving, by a movement mechanism, the first bottle-containing module or one piercer base to move, so that a piercer on the one piercer base pierces the first medicine container, and driving, by the movement mechanism, the second bottle-containing module or the other piercer base to move, so that a piercer on the other piercer base pierces the second medicine container;

operating a peristaltic pump to dissolve and mix medicines;

after the dissolving and mixing operation is completed, driving, by the movement mechanism, the first bottle-containing module or the one piercer base to move, so that the piercer on the one piercer base separates from the first medicine container, and driving, by the movement mechanism, the second bottle-containing module or the other piercer base to move, so that the piercer on the other piercer base separates from the second medicine container.

Other aspects will be apparent upon reading and understanding brief description of drawings and embodiments of the present application.

BRIEF DESCRIPTION OF DRAWINGS

When considered in conjunction with the accompanying drawings, the embodiments of the present application can be more completely and better understood and many accompanying advantages thereof can be readily known by referring to the following detailed description. The drawings described herein are used to provide a further understanding of the embodiments of the present application and form a part of the embodiments of the present application. The illustrative embodiments of the present application and the description thereof are used to explain the present application and do not constitute limitations to the present application, as shown in the drawings.

EMBODIMENTS

Figure 1:
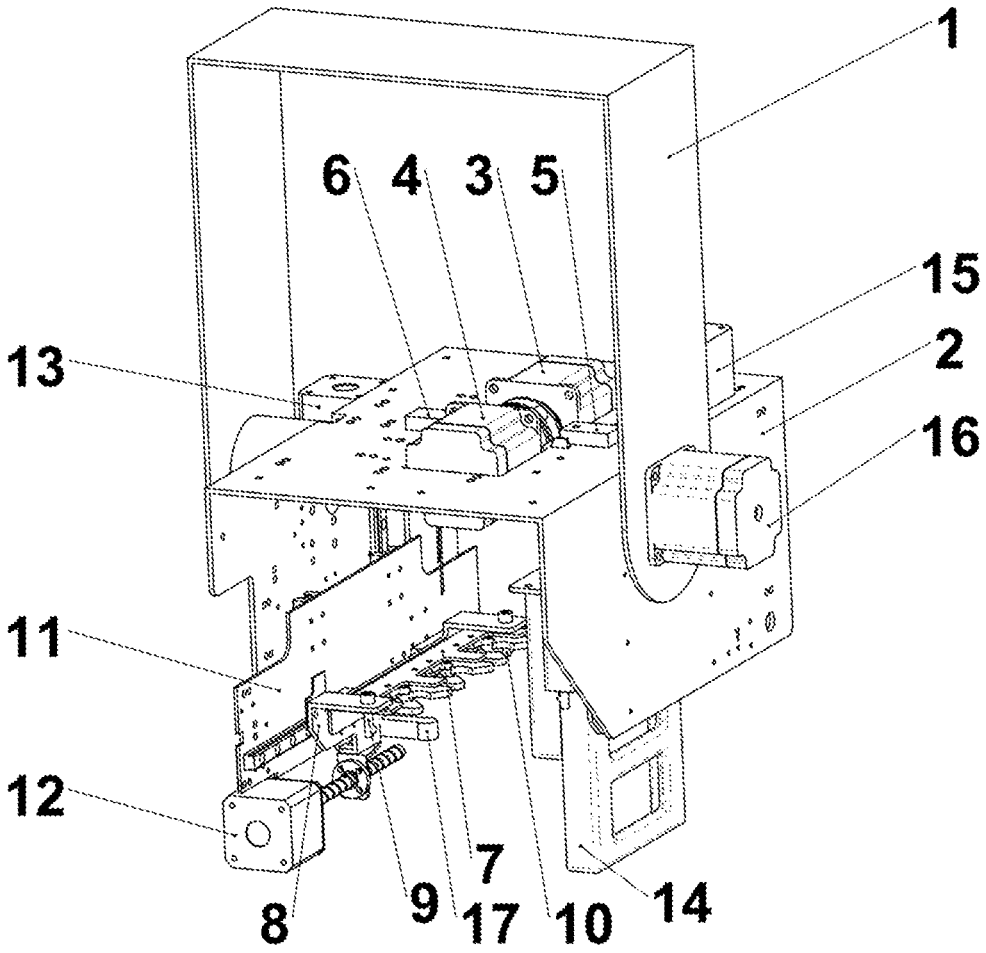
FIG. 1 is a schematic left perspective view of the structure of a dissolving and mixing unit according to an embodiment of the present application.

It will be apparent that various modifications and changes made by those skilled in the art according to the concepts of the present application fall within the protection scope of the present application.

The dissolving and mixing unit provided by the present application has the following advantages.

The dissolving and mixing unit provided by the present application can realize automatic dissolving and mixing operation with high efficiency, and can realize the preparation of contents in one or more of the first medicine containers and contents in the second medicine container without manual operation by a medical staff during the dissolving and mixing process, thereby greatly reducing the labor intensity for the medical staff; fully hermetic preparation can be realized during the dissolving and mixing process, minimizing the number of piercings, thereby reducing contamination during the preparation, significantly improving the safety of the prepared medicine and while reducing spatter and volatilization of the medicine, which is beneficial to ensure the health and safety of the medical staff; and the design form of the dissolving and mixing unit is convenient to combine a plurality of dissolving and mixing units, so that it is possible to perform multi-task and parallel dissolving and mixing operations, thus notably improving the speed and efficiency of the dissolving and mixing process, and significantly fulfilling clinical needs.

Embodiment 1

As shown in FIGS. 1-5, the embodiment provides a dissolving and mixing unit, comprising: a support 2, peristaltic pumps 3 and 4, a dissolving and mixing device 37, a first bottle-containing module 7 and a second bottle-containing module 14, and a movement mechanism.

Figure 2:
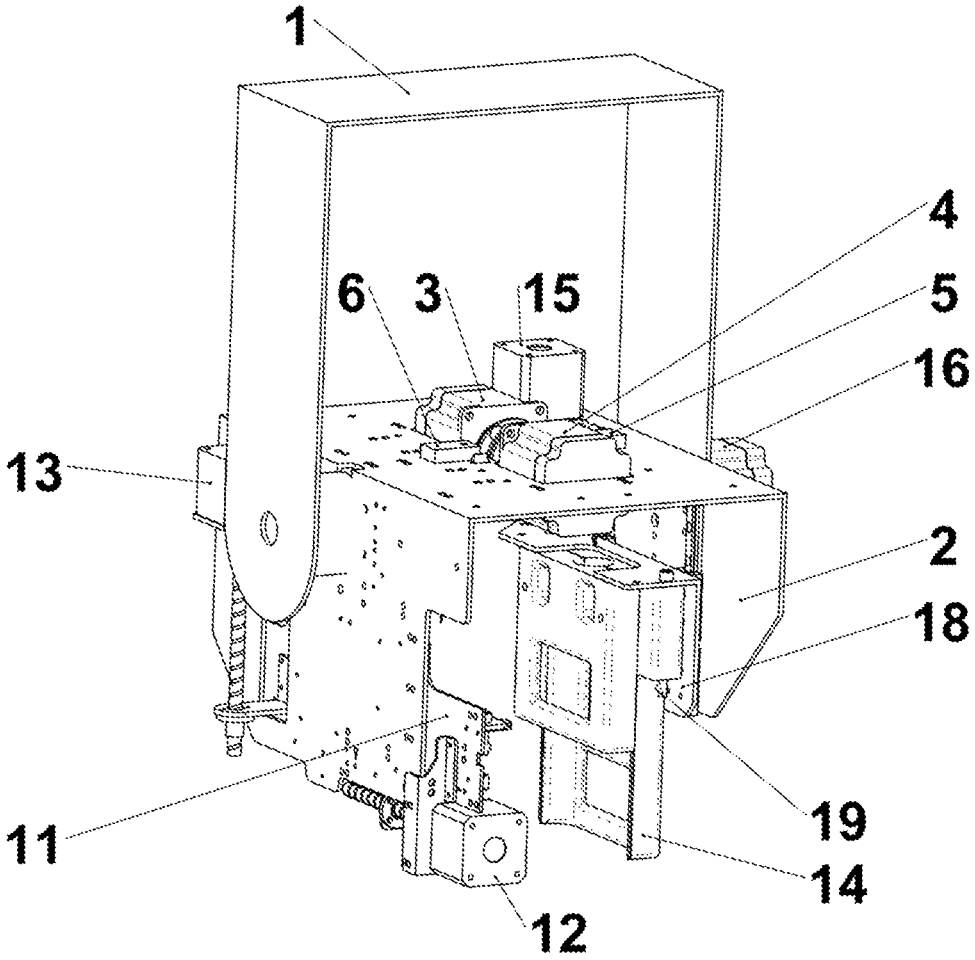
FIG. 2 is a schematic right perspective view of the structure of the dissolving and mixing unit shown in FIG. 1.
Figure 3:
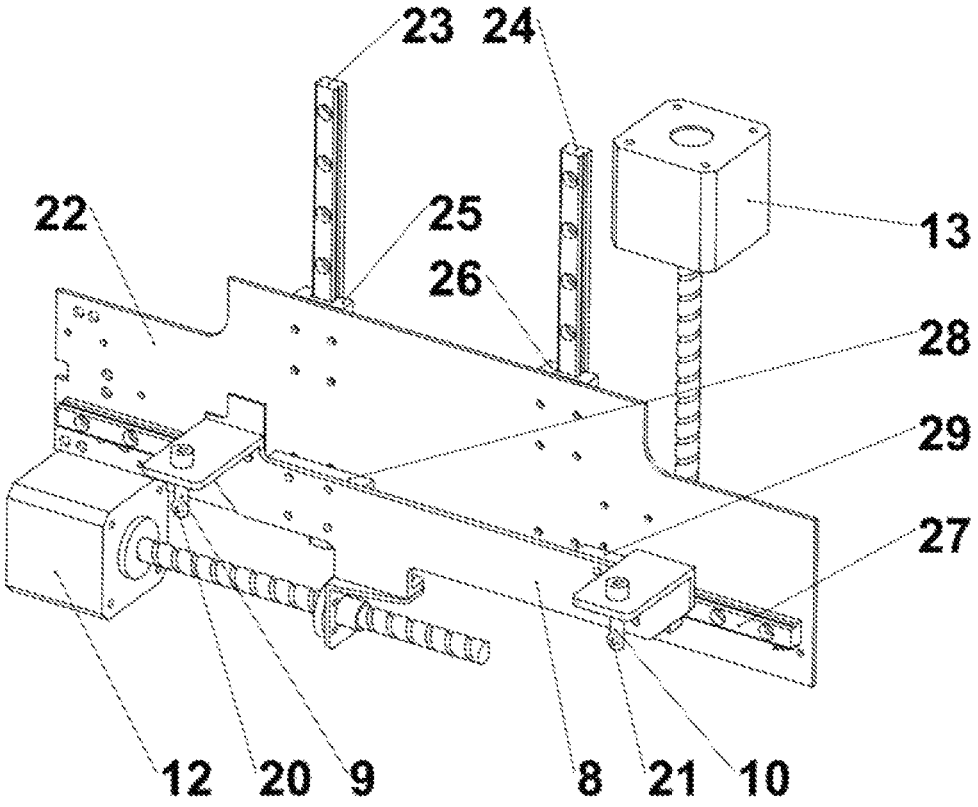
FIG. 3 is a schematic view of the structure of a first movement mechanism in FIG. 1.
Figure 4:
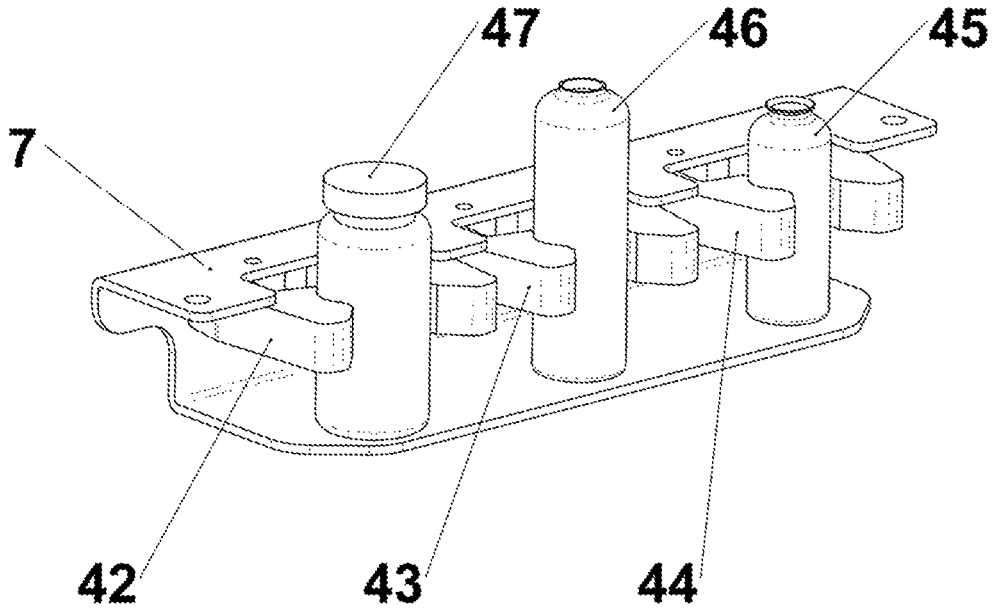
FIG. 4 is a schematic view of the structure of a bottle-containing module equipped with first medicine containers in FIG. 1.
Figure 5:
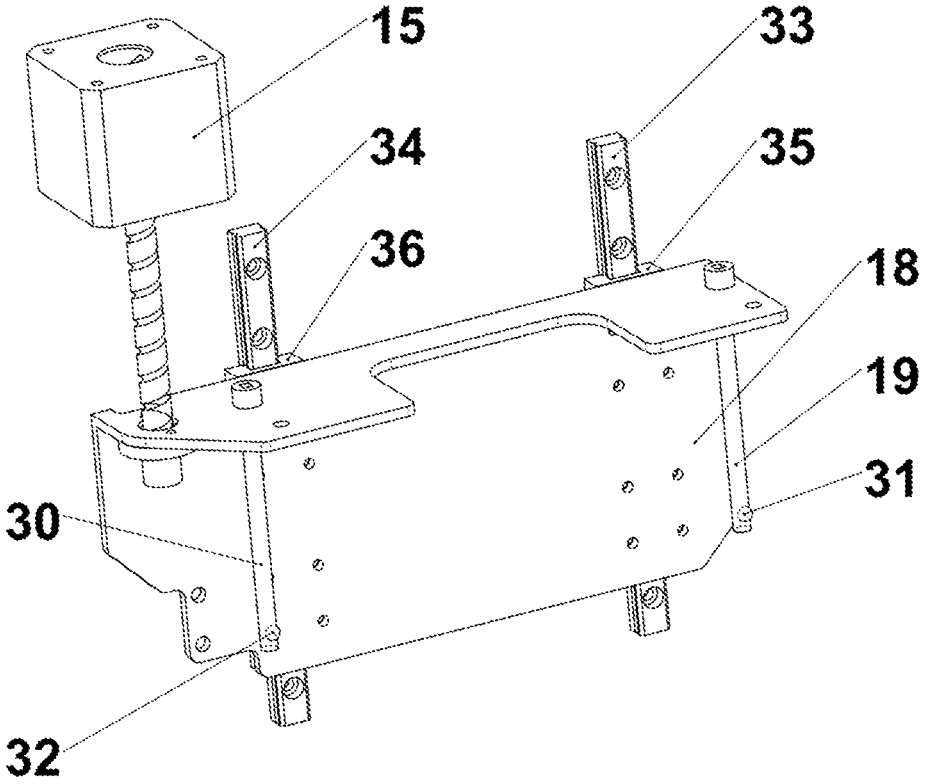
FIG. 5 is a schematic view of the structure of a second movement mechanism in FIG. 1.

As shown in FIGS. 1 and 2, two peristaltic pumps 3 and 4 are mounted on the support 2, facing each other.

Figure 6:
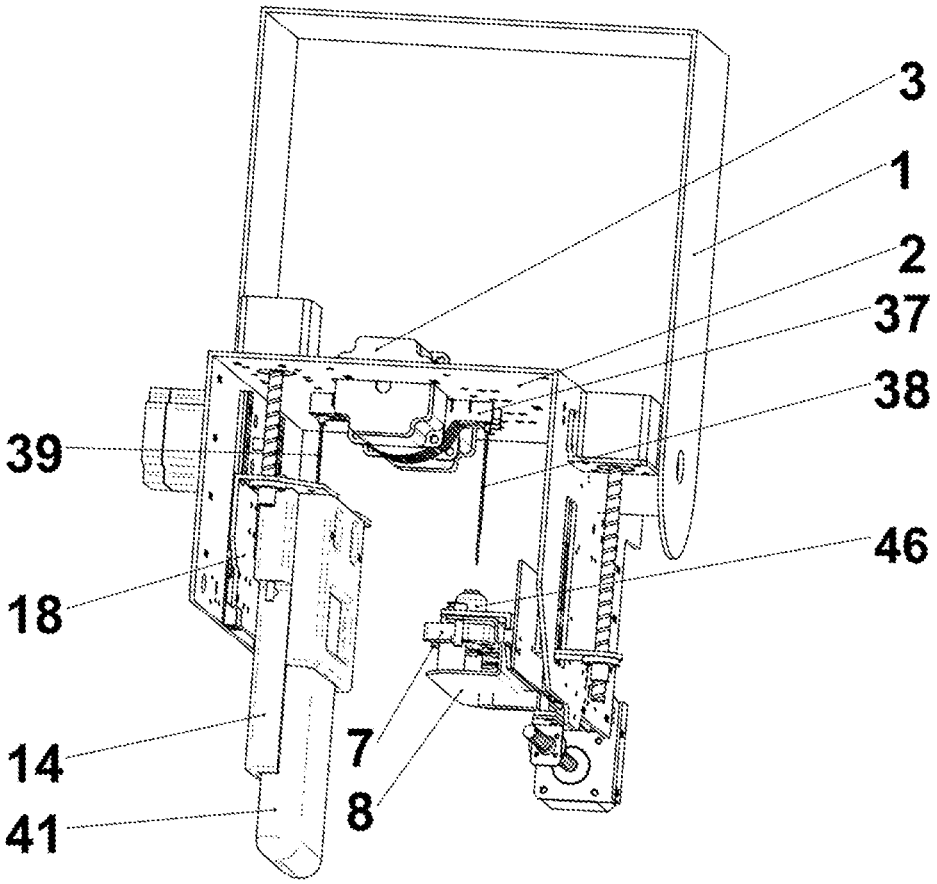
FIG. 6 is a schematic view of the dissolving and mixing unit during operation when used for dissolving and mixing medicines shown in FIG. 1.

The specific structure of the dissolving and mixing device 37 can be any part or parts of those provided in the patent application entitled "Dissolving and Mixing Device" (application No. CN2017207563764) filed by the applicant, and shall not be described in detail in the present application. The dissolving and mixing device 37 (see FIG. 6) includes two dissolving and mixing channels, and peristaltic pumps 3 and 4 may be configured to squeeze elastic infusion hoses in the two dissolving and mixing channels, respectively. Of course, the dissolving and mixing device 37 may include an alternative number of the dissolving and mixing channels, such as one or more than three (including three), and the number of the peristaltic pumps is identical to the number of the dissolving and mixing channels. The dissolving and mixing device 37 may be assembled and fixed on the support 2. Optionally, the dissolving and mixing device 37 is snapped onto the support 2 by way of engaging a snap lock on the frame with a receiving seat on the support 2. Still optionally, as shown in FIG. 1, the support 2 is provided with snap release mechanisms 5 and 6 to separate the snap lock from the receiving seat, and thereby releasing the dissolving and mixing device 37.

After the dissolving and mixing device 37 is assembled and secured, the dissolving and mixing device 37 is combined with the peristaltic pumps 3 and 4 which are mounted on the support 2, and the peristaltic pumps 3 and 4 may squeeze the elastic infusion hoses in the dissolving and mixing device 37.

The first bottle-containing module 7 is mounted on the support 2 and configured to position and secure the first medicine container (which may be a vial or an ampoule bottle). The second bottle-containing module 14 is mounted on the support 2 and configured to position and secure the second medicine container (which may be an infusion container).

The movement mechanism is configured to drive the first bottle-containing module 7 to move, so that a piercer 38 on one piercer base pierces the first medicine container located in the first bottle-containing module 7 or separates from the first medicine container; and the movement mechanism is also configured to drive the second bottle-containing module 14 to move, so that a piercer 39 on the other piercer base pierces the second medicine container located in the second bottle-containing module 14 or separates from the second medicine container.

Optionally, the movement mechanism comprises a first movement mechanism 11, which is mounted on the support 2, and the first movement mechanism 11 may drive the first bottle-containing module 7 to move. Optionally, the first bottle-containing module 7 is located above or below the dissolving and mixing device 37, and the first movement mechanism 11 may drive the first bottle-containing module 7 to move longitudinally.

In the embodiment shown in the figures, the first movement mechanism 11 includes a first receiving frame 8, a longitudinal drive motor 13, first longitudinal slide rails 23 and 24 arranged in parallel, first longitudinal slide blocks 25 and 26.

The first longitudinal slide rails 23 and 24 are mounted on the support 2, the first longitudinal slide blocks 25 and 26 are respectively installed on the first longitudinal slide rails 23 and 24, and the first receiving frame 8 is installed and mounted on the first longitudinal slide blocks 25 and 26 for receiving the first bottle-containing module 7. The first receiving frame 8 is provided with first receiving rods 9 and 10. Both ends of the first bottle-containing module 7 may be installed on the first receiving rods 9 and 10 respectively, and may be releasably mounted by first locking mechanisms 20 and 21 on the first receiving rods 9 and 10.

The longitudinal drive motor 13 can drive the first longitudinal slide blocks 25 and 26 to move longitudinally along the first longitudinal slide rails 23 and 24 respectively, thereby driving the first bottle-containing module 7 on the first receiving frame 8 to move longitudinally, so that the first medicine container mounted in the first bottle-containing module 7 is pierced by the piercer 38.

Optionally, the movement mechanism comprises a second movement mechanism which is installed on the support 2, and the second movement mechanism may drive the second bottle-containing module 14 to move. Optionally, the second bottle-containing module 14 is located above or below the dissolving and mixing device 37, and the second movement mechanism may drive the second bottle-containing module 14 to move longitudinally.

In the embodiment shown in the figures, the second movement mechanism comprises a second receiving frame 18, a longitudinal drive motor 15, second longitudinal slide rails 33 and 34 arranged in parallel, second longitudinal slide blocks 35 and 36.

The second receiving frame 18 is provided with second receiving rods 19 and 30. Both ends of the second bottle-containing module 14 may be installed on the second receiving rods 19 and 30 respectively, and may be releasably mounted by second locking mechanisms 31 and 32 on the second receiving rods 19 and 30.

The second longitudinal slide rails 33 and 34 are mounted on the support 2, the second longitudinal slide blocks 35 and 36 are respectively mounted on the second longitudinal slide rails 33 and 34, and may slide along the second longitudinal slide rails 33 and 34 respectively. The second receiving frame 18 is fixed to the second longitudinal slide blocks 35 and 36. Driven by the longitudinal movement motor 15, the second receiving frame 18 drives the second longitudinal slide blocks 35 and 36 to move longitudinally along the second longitudinal slide rails 33 and 34, thereby driving the second bottle-containing module 14 mounted on the second receiving frame 18 to move longitudinally.

Optionally, the first bottle-containing module 7 includes a plurality of bottle-containing elements, each bottle-containing element being configured to secure a first medicine container. In the example as shown in the figures, the bottle-containing element is an elastic clamping mechanism, which may be configured for positioning and securing the vial and/or the ampoule bottle. Furthermore, in the example as shown in the figures, the first bottle-containing module 7 is provided with three elastic clamping mechanisms 42, 43, and 44 which are transversely and linearly arranged. Three vials and/or ampoule bottles in total may be placed therein. The vial 47 and ampoule bottles 45 and 46 are linearly arranged in the elastic clamping mechanisms 42, 43, and 44. It should be noted that in actual applications, the number of elastic clamping mechanisms may be increased or decreased according to clinical needs.

In order to enable each of the vial 47 and the ampoule bottles 45 and 46 mounted on the first bottle-containing module 7 to be pierced by the piercer 38, the movement mechanism further comprises a third movement mechanism which is configured to drive the first bottle-containing module 7 to move transversely, so that each of the vial 47 and the ampoule bottles 45 and 46 may move transversely to correspond longitudinally to the piercer 38 on the piercer base, and then the vial 47 or the ampoule bottle 45 or 46 is driven by the first movement mechanism 11 to move longitudinally, so as to be pierced by the piercer 38.

In the example as shown in the figures, the third movement mechanism includes a transverse drive motor 12, a transverse slide rail 27, transverse slide blocks 28 and 29, and a supporting platform 22.

The supporting platform 22 is mounted on the first longitudinal slide blocks 25 and 26, and the transverse slide rail 27 is mounted on the supporting platform 22. The transverse slide blocks 28 and 29 are mounted on the transverse slide rail 27, and driven by the transverse drive motor 12, may move transversely along the transverse slide rail 27.

While piercing the first medicine container by the piercer 38, the transverse drive motor 12 may first drive the transverse slide blocks 28 and 29 to move along the transverse slide rail 27 so that the first medicine container (the vial 47 or the ampoule bottle 45 or 46) corresponds longitudinally to the piercer 38, and then the longitudinal drive motor 13 drives the first longitudinal slide blocks 25 and 26 to move longitudinally along the first longitudinal slide rails 23 and 24 respectively, thereby driving the first medicine container on the first receiving frame 8 to move longitudinally so that the first medicine container is pierced by the piercer 38.

It should be noted that the longitudinal drive motors 13 and 15 and the transverse drive motor 12 each include a rotary motor and a transmission mechanism that converts rotary movement into linear movement. Of course, the longitudinal drive motors 13 and 15 and the transverse drive motor 12 may be linear motors to directly drive the slide blocks to move along the slide rails.

Optionally, the dissolving and mixing unit may further comprise a vibration module 17, which may vibrate the first bottle-containing module, thereby driving the vial 47 and/or ampoule bottles 45 and 46 mounted on the first bottle-containing module 7 to vibrate in order to facilitate dissolving and admixing the medicine. In the embodiment as shown in the figures, the vibration module 17 is a vibration motor.

Optionally, the dissolving and mixing unit of the embodiment further includes a base 1 and a second rotary drive module. The support 2 may be mounted on the base 1 and may be driven by the second rotary drive module to rotate, thereby driving all components mounted on the support 2 to rotate, enabling the medicine containers to exhibit desired orientation during the dissolving and mixing process. In the embodiment as shown in the figures, the second rotary drive module is a rotary motor 16.

Embodiment 2

Figure 7:
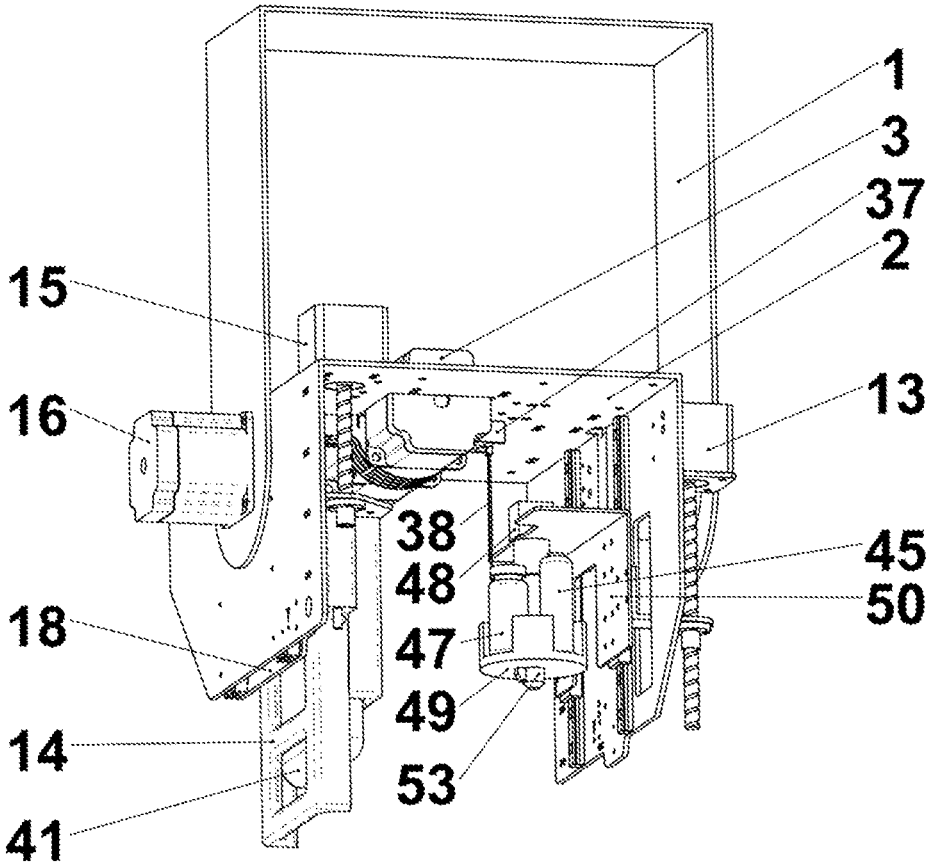
FIG. 7 is a schematic perspective view of the structure of a dissolving and mixing unit according to another embodiment of the present application.
Figure 8:
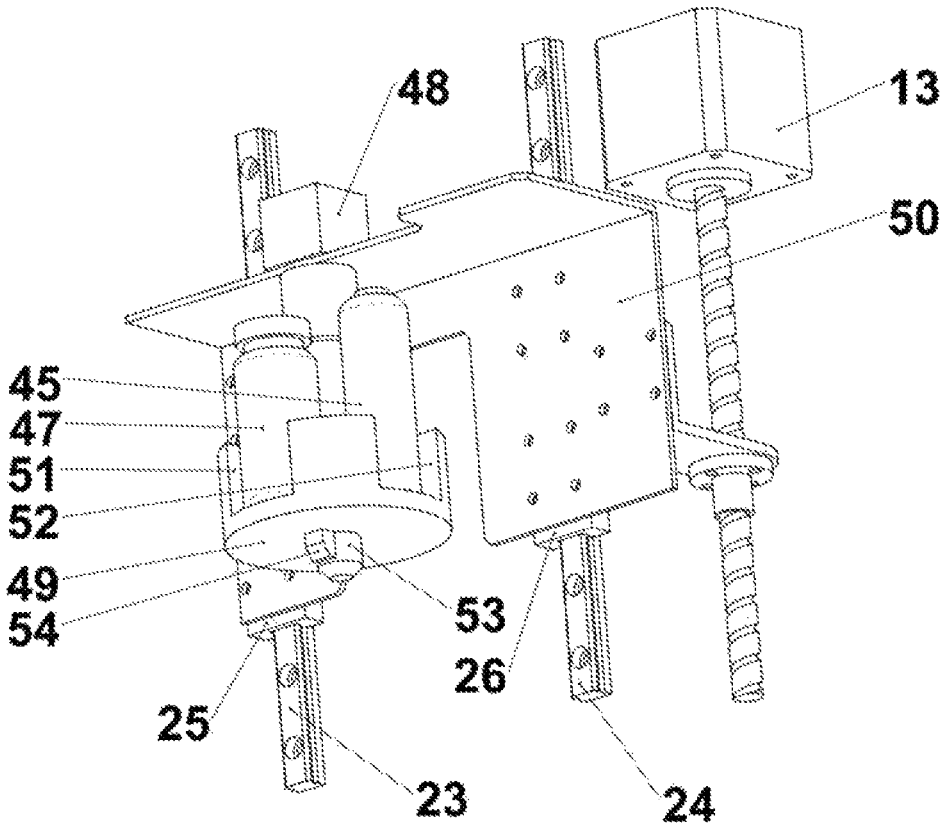
FIG. 8 is a schematic view of the structure of a first medicine container control device equipped with first medicine containers in FIG. 7.
Figure 9:
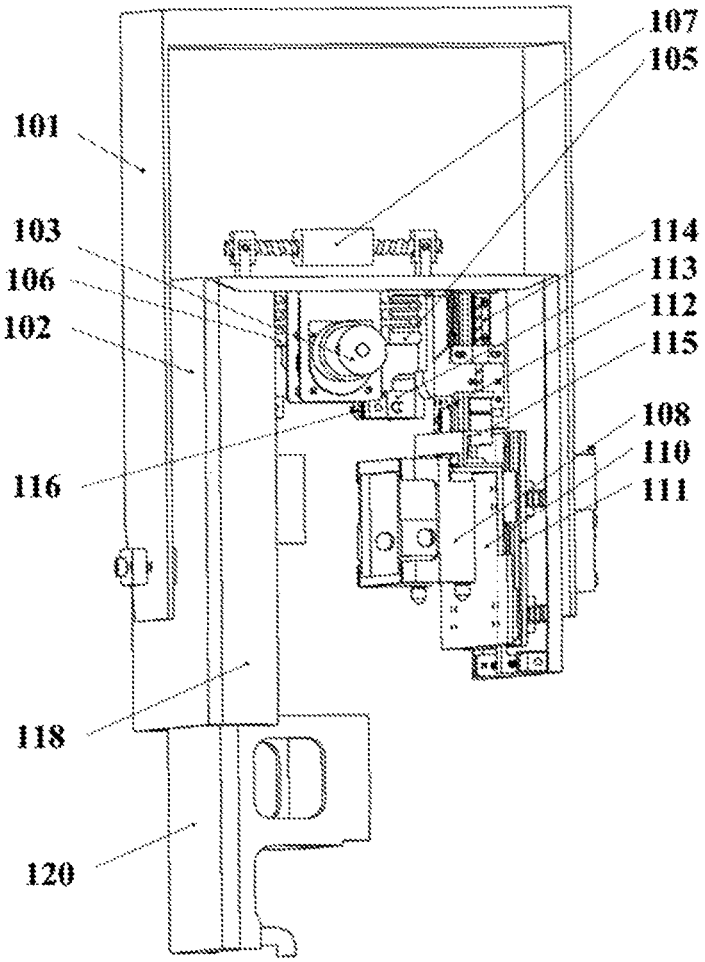
FIG. 9 is a schematic front left-side perspective view of the structure of a dissolving and mixing unit according to yet another embodiment of the present application.
Figure 10:
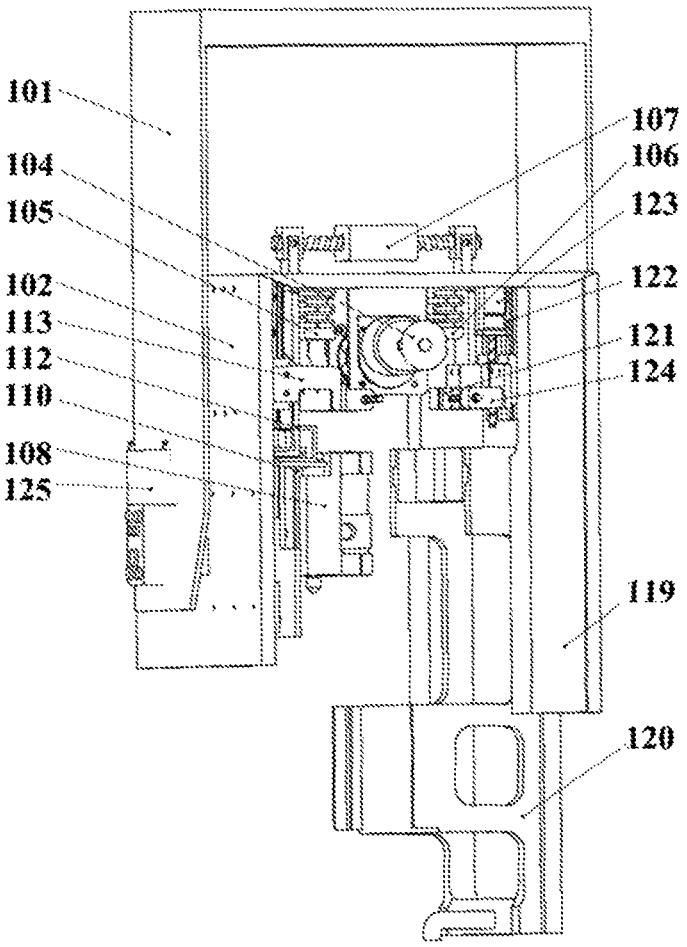
FIG. 10 is a schematic rear left-side perspective view of the structure of the dissolving and mixing unit shown in FIG. 9.
Figure 11:
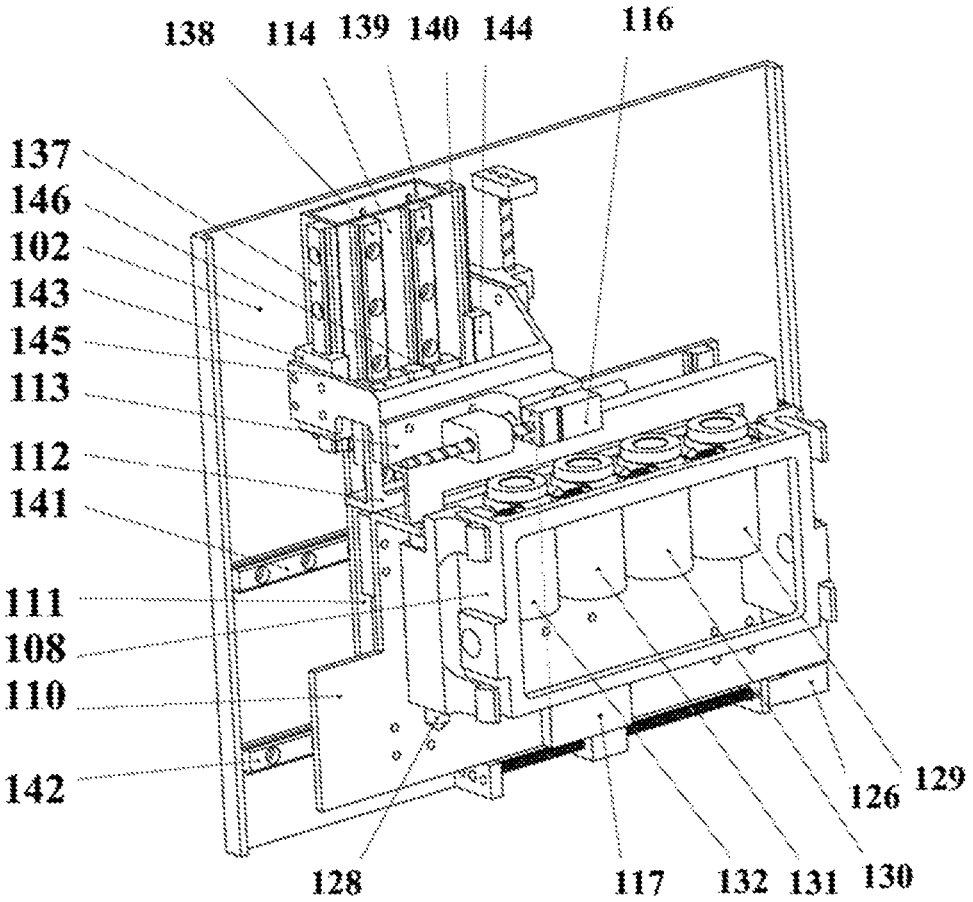
FIG. 11 is a schematic perspective view of the structure of the first bottle-containing module with vials assembled thereon of the dissolving and mixing unit shown in FIG. 9.
Figure 12:
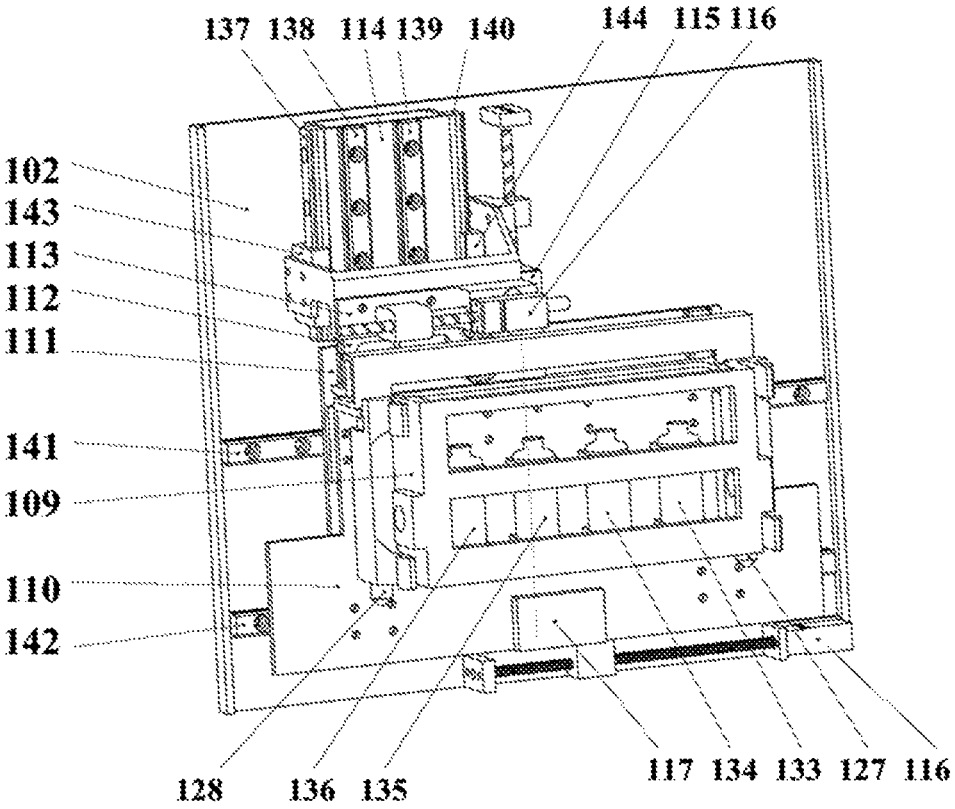
FIG. 12 is a schematic perspective view of the structure of the first bottle-containing module with ampoule bottles assembled thereon of the dissolving and mixing unit shown in FIG. 9.
Figure 13:
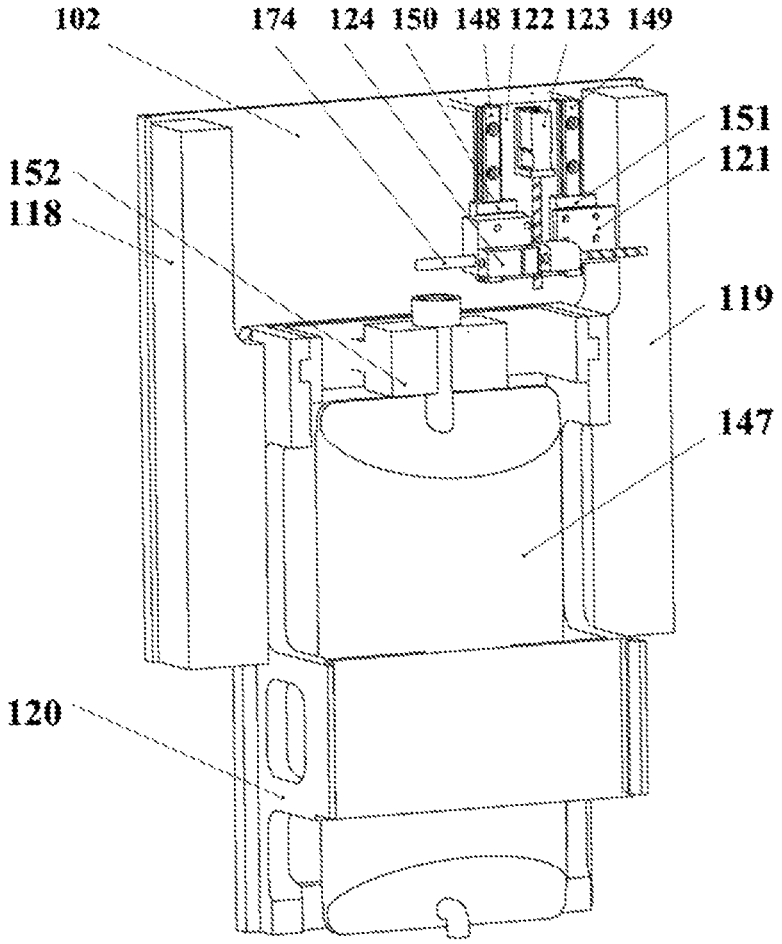
FIG. 13 is a schematic perspective view of the structure of the second bottle-containing module with the infusion container assembled thereon of the dissolving and mixing unit shown in FIG. 9.
Figure 14:
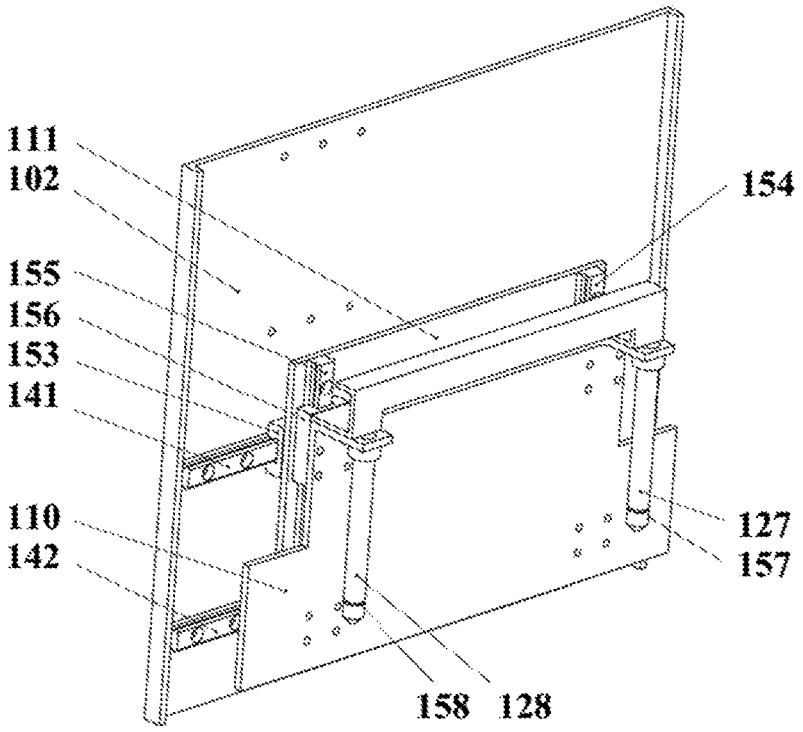
FIG. 14 is a schematic perspective view of the structure of the transverse slide plate connected with the receiving frame of the dissolving and mixing unit shown in FIG. 9.
Figure 15:
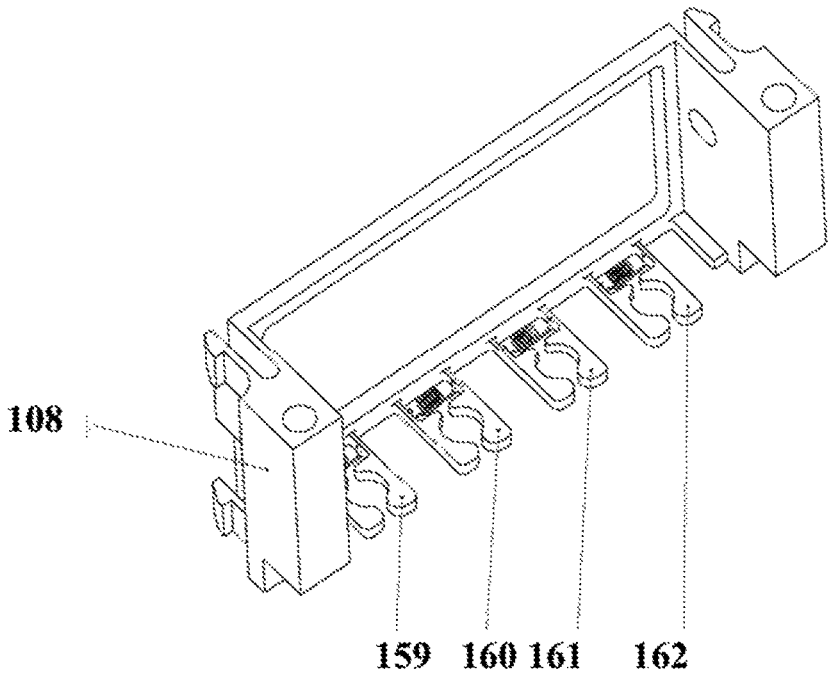
FIG. 15 is a schematic perspective view of the structure of the first bottle-containing module of the dissolving and mixing unit as a vial-containing module shown in FIG. 9.
Figure 16:
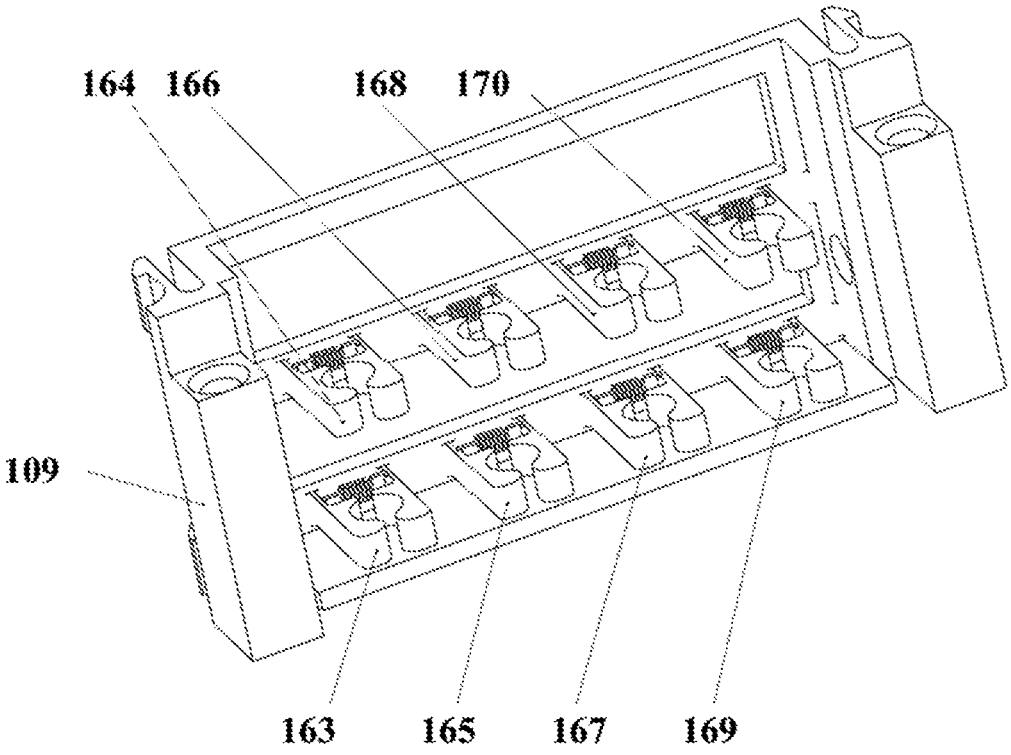
FIG. 16 is a schematic perspective view of the structure of the first bottle-containing module of the dissolving and mixing unit as an ampoule bottle-containing module shown in FIG. 9.
Figure 17:
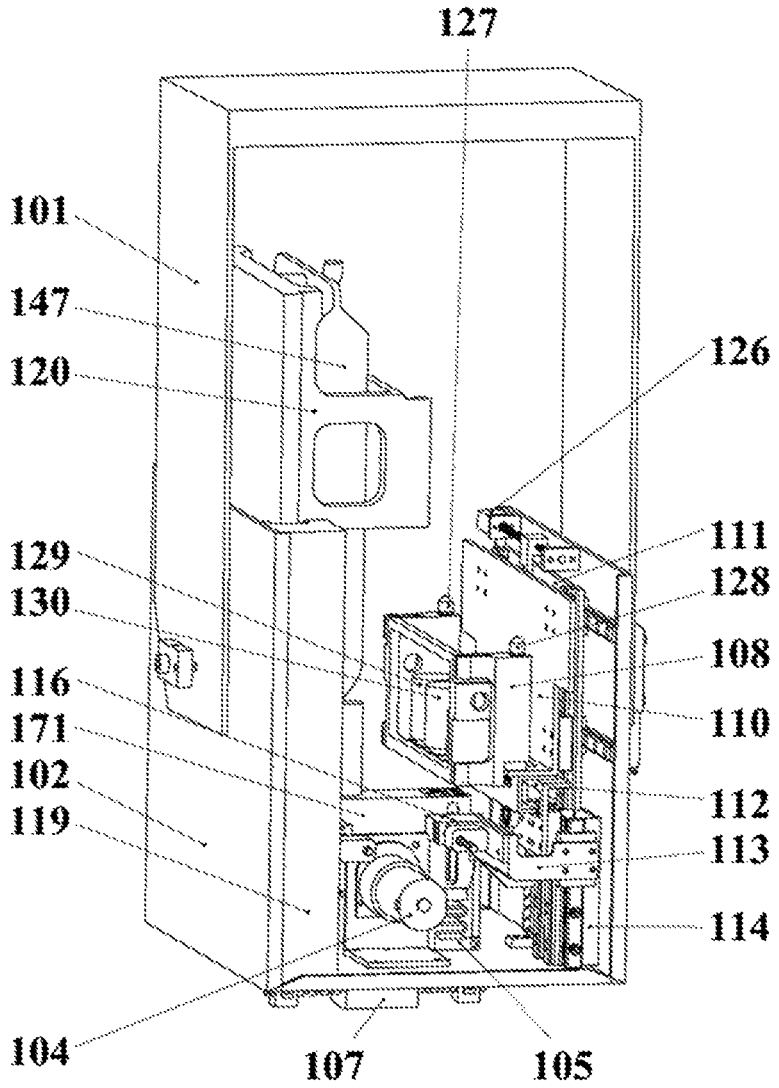
FIG. 17 is a schematic view of the state of the dissolving and mixing unit shown in FIG. 9 for dispensing medicines in vials.
Figure 18:
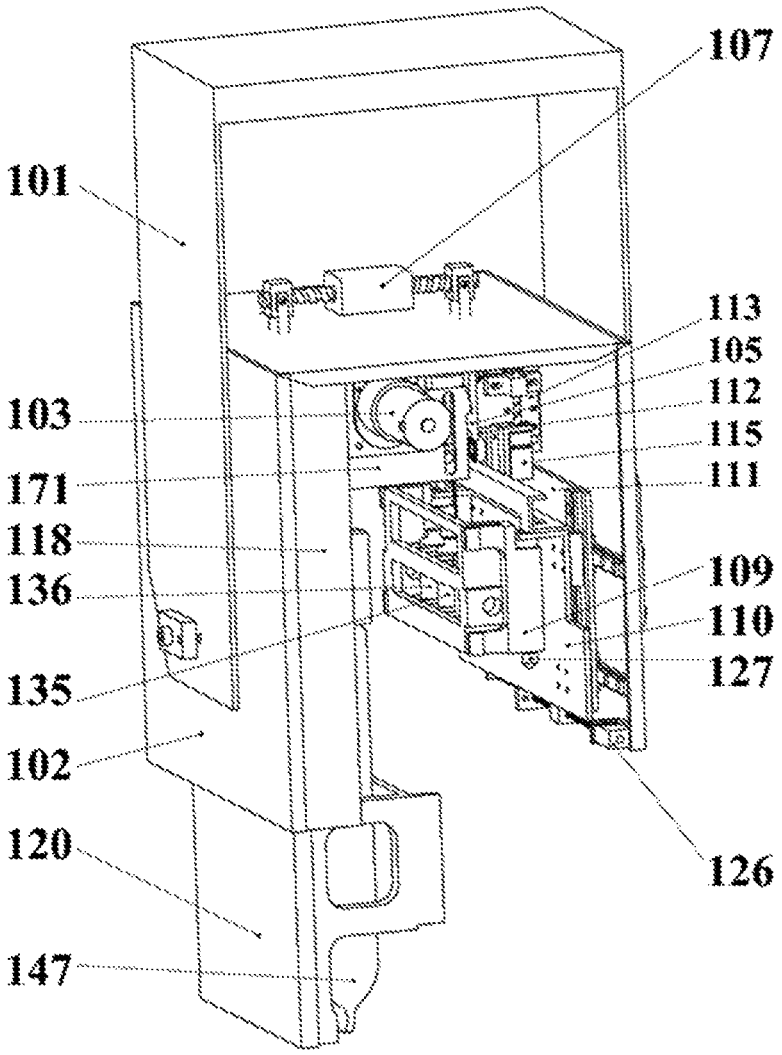
FIG. 18 is a schematic view of the state of the dissolving and mixing unit shown in FIG. 9 for dispensing medicines in ampoule bottles.
Figure 19:
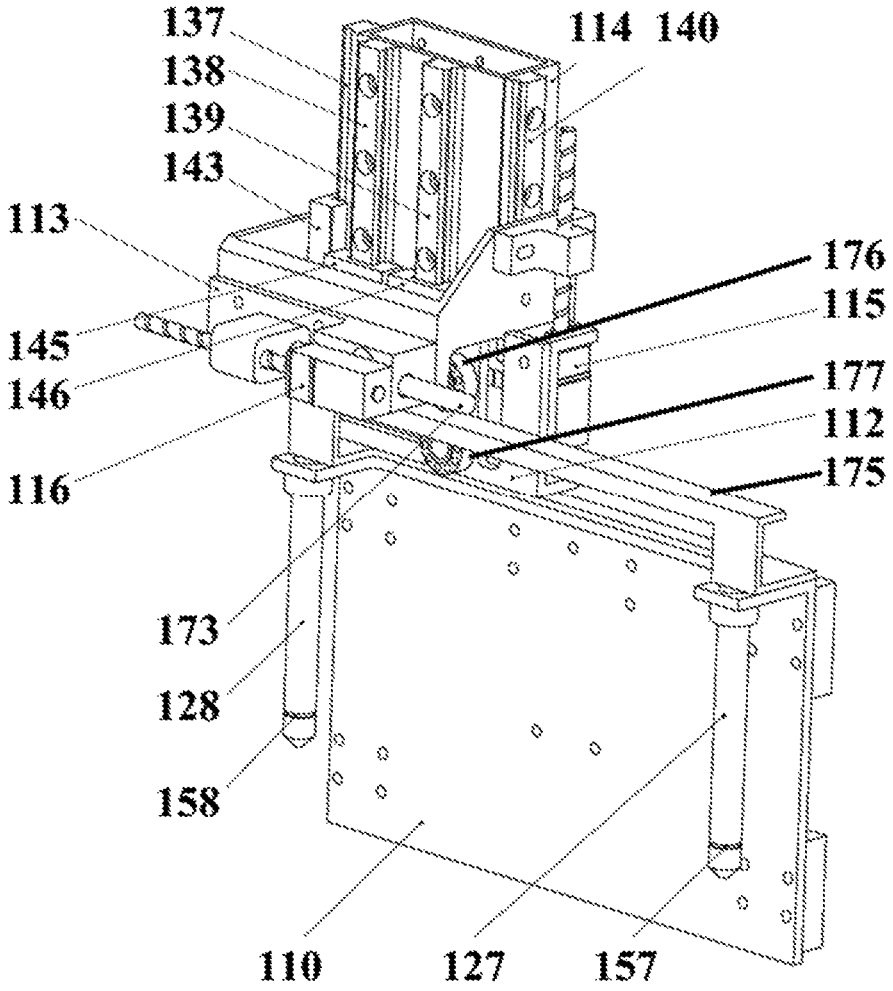
FIG. 19 is a schematic perspective view of the connection structure of the receiving frame, the movement control plate and the first needle shifter of the dissolving and mixing unit shown in FIG. 9.

As shown in FIGS. 7-8, the embodiment provides a dissolving and mixing unit, which differs from that of Embodiment 1 mainly in the arrangement of a plurality of bottle-containing elements on the first bottle-containing module and the structure of the third movement mechanism.

In the embodiment, the first bottle-containing module 49 is shown in FIG. 8. The bottle-containing module 49 is configured to a disk shape and is provided with four elastic clamping mechanisms (only two elastic clamping mechanisms 51, 52 of which are shown in FIG. 8) arranged along a circumferential direction of the disk. Four vials and/or ampoule bottles in total may be placed therein. Of course, in actual applications, the number of the elastic clamping mechanisms may be increased or decreased according to clinical needs.

The third movement mechanism may drive the first bottle-containing module 49 to rotate, so that each of the four vials and ampoule bottles may be rotated to correspond longitudinally to the piercer 38 on a piercer base, and then the first movement mechanism 11 drives the corresponding vial or ampoule bottle to move longitudinally so as to be pierced by the piercer 38.

In the embodiment as shown in the figures, the third movement mechanism comprises a first rotary drive module and a first receiving rod. The first rotary drive module may be a rotary motor 48, the first receiving rod 53 may be disposed on the first receiving frame 50, and the first receiving rod 53 is rotatably connected with the first receiving frame 50 and may rotate relative to the first receiving frame 50, driven by the rotary motor 48. The first bottle-containing module 49 may be mounted on the first receiving rod 53 and releasably mounted by a first locking mechanism 54 on the first receiving rod 53.

With reference to specific examples, the process of dissolving and mixing medicines by using the dissolving and mixing units in the above two embodiments will be described below.

Example 1: Preparation of Medicines in Ampoule Bottles

The preparation process performed by using the dissolving and mixing unit described in Embodiment 1 is as follows.

Firstly, the infusion container 41 is positioned and secured in the second bottle-containing module 14, and the second bottle-containing module 14 is assembled and mounted on the second receiving frame 18. An ampoule bottle is positioned and secured in the first bottle-containing module 7, and then the first bottle-containing module 7 is assembled and mounted on the first receiving rods 9 and 10 of the first receiving frame 8. At this point, the opening of the ampoule bottle is pointing upward.

Next, the longitudinal drive motor 13 drives the supporting platform 22 (and therefore the first bottle-containing module 7) to move longitudinally upwards, so that the piercer 38 of the dissolving and mixing device 37 is inserted into the ampoule bottle, and the piercer 38 is inserted as deep as possible towards the bottom of the ampoule bottle; subsequently or simultaneously, the longitudinal drive motor 15 may drive the second receiving frame 18 to move longitudinally upwards and may drive the infusion container 41 to move longitudinally so that the piercer 39 of the dissolving and mixing device 37 pierces into the rubber stopper of the infusion container 41.

Then, the peristaltic pumps 3 and 4 are operated to pump the medicine solution in the ampoule bottle directly into the infusion container 41.

(i) If only one ampoule bottle 45 is placed on the first bottle-containing module 7, the dissolving and mixing process would be complete at this point. If so the longitudinal drive motor 13 drives the first receiving frame 8 to move reversely in a longitudinal direction (downwardly displace), and the longitudinal drive motor 15 drives the second receiving frame 18 to move reversely in a longitudinal direction (downwardly displace), so that the piercers 38 and 39 of the dissolving and mixing device are separated from the ampoule bottle 45 and the infusion container 41 respectively, thus completing the preparation.

(ii) If a plurality of ampoule bottles are placed on the first bottle-containing module 7, for example, when two ampoule bottles 45 and 46 are placed on the first bottle-containing module 7, the longitudinal drive motor 13 drives the first bottle-containing module 7 to move downwards in order to separate the piercer 38 from the ampoule bottle 45; then, the transverse drive motor 12 drives the first receiving frame 8 to move transversely so as to transversely move the first bottle-containing module 7 until the ampoule bottle 46 longitudinally corresponds to the piercer 38; then, the longitudinal drive motor 13 drives the supporting platform 22 to move longitudinally upwards, so that the piercer 38 is inserted into the ampoule bottle 46, and the piercer 38 is inserted as deep as possible towards the bottom of the ampoule bottle 46; subsequently, again according to the above dispensing procedure, the peristaltic pumps 3 and 4 are initiated to pump the medicine in the ampoule bottle 46 into the infusion container 41. At this point, the dissolving and mixing process is complete.

If at least three ampoule bottles are placed on the first bottle-containing module 7, the step (ii) described above is repeated until the medicines in all ampoule bottles are pumped into the infusion container 41. At this point, the dissolving and mixing process is complete.

After the dissolving and mixing process is complete, the longitudinal drive motor 13 drives the first receiving frame 8 to move downward, and the longitudinal drive motor 15 drives the second receiving frame 18 to move downward, so that the piercers 38 and 39 of the dissolving and mixing device are separated from the ampoule bottle and the infusion container 41 respectively, thus completing the preparation.

Compared to the preparation performed by using the dissolving and mixing unit of Embodiment 1, the preparation performed by using the dissolving and mixing unit of Embodiment 2 is different in: the step (ii) when a plurality of ampoule bottles are placed on the bottle-containing module 49.

When the dissolving and mixing unit of Embodiment 2 is used for the preparation, the step (ii) is as follows:

after the longitudinal drive motor 13 drives the ampoule bottle 45 to move downwards to separate the piercer 38 from the ampoule bottle 45, the rotary motor 48 drives the first receiving rod 53 and the bottle-containing module 49 to rotate, so that the next ampoule bottle on the bottle-containing module 49 is rotated to correspond longitudinally to the piercer 38; then the longitudinal drive motor 13 drives the first receiving frame 50 to move longitudinally upwards, so that the piercer 38 is inserted into the next ampoule bottle, and the piercer 38 is inserted as deep as possible towards the bottom of the next ampoule bottle; subsequently, again according to the above dispensing procedure, peristaltic pumps 3 and 4 are initiated to pump the medicine in the next ampoule bottle into the infusion container 41;

the above step (ii) is repeated until the medicines in all ampoule bottles are pumped into the infusion container 41, at which point the dissolving and mixing process is completed.

Example 2: Preparation of Solid Medicine in Vials

The preparation performed by using the dissolving and mixing unit described in s Embodiment 1 is as follows.

Firstly, the infusion container 41 is positioned and secured in the second bottle-containing module 14, and the second bottle-containing module 14 is assembled and mounted on the second receiving frame 18. The vial is positioned and secured in the first bottle-containing module 7, and the first bottle-containing module 7 is assembled and mounted on the first receiving rods 9 and 10 of the first receiving frame 8.

Next, the longitudinal drive motor 13 drives the supporting platform 22 to move longitudinally upwards, and drives the first bottle-containing module 7 to move longitudinally upwards, so that the piercer 38 of the dissolving and mixing device 37 pierces the rubber stopper of the vial, and any one piercer is inserted as deep as possible towards the bottle bottom of the vial, so that the medicine solution can be transferred to the infusion container 41 as much as possible in the dissolving and mixing process; subsequently or simultaneously, the longitudinal drive motor 15 may drive the second receiving frame 18 to move longitudinally upwards, and drive the infusion container 41 to move longitudinally so that the piercer 39 of the dissolving and mixing device 37 pierces into the rubber stopper of the infusion container 41.

Then, the peristaltic pumps 3 and 4 are operated to pump the medicine solution in the infusion container 41 into the vial rapidly through one dissolving and mixing channel, and to pump out the medicine solution in the vial through the other dissolving and mixing channel at the same time, thus forming a circulating reflux state between the vial and the infusion container 41, while generating intense turbulence within the vial, continuously and intensely agitating the medicine solution and undissolved medicine in the vial, and by continuously and dynamically pumping in and out a large amount of infusion, the concentration of the limited volume solution in the vial is continuously and rapidly diluted, thus accelerating the dissolution of the medicine; while the medicine solution is circulated and reflowed, the support 2 may be rotated and/or the vibration module 17 may be driven in order to speed up the dissolution of the medicine and to balance the air pressure in the vial and the infusion container 41; after the medicine is completely dissolved, the medicine solution in the vial is completely pumped into the infusion container 41.

(i) If only one vial 47 is placed on the first bottle-containing module 7, the dissolving and mixing process would be complete at this point. The longitudinal drive motor 13 drives the first receiving frame 8 to move downwards, and the longitudinal drive motor 15 drives the second receiving frame 18 to move reversely in a longitudinal direction (downwardly displace), so that the piercers 38 and 39 of the dissolving and mixing device are separated from the vial 47 and the infusion container 41 respectively, thus completing the preparation.

(ii) If a plurality of vials are placed on the first bottle-containing module 7, the longitudinal drive motor 13 drives the first bottle-containing module 7 to move downwards so as to separate the piercer 38 from the vial; then, the transverse drive motor 12 drives the first receiving frame 8 to move transversely so as to move the first bottle-containing module 7 transversely until the second vial corresponds longitudinally to the piercer 38; then the longitudinal drive motor 13 drives the supporting platform 22 to move longitudinally upwards, so that the piercer 38 pierces the rubber stopper of the second vial, and subsequently the medicine in the second vial is dissolved and transferred to the infusion container 41 according to the above-mentioned dissolving and mixing procedure.

The step (ii) described above is repeated until medicines in all vials are dissolved and transferred to the infusion container 41, at which point the dissolving and mixing process is complete.

After the dissolving and mixing process is complete, the longitudinal drive motor 13 drives the first receiving frame 8 to move downwards, and the longitudinal drive motor 15 drives the second receiving frame 18 to move downwards, so that the piercers 38 and 39 of the dissolving and mixing device are separated from the vials and the infusion container 41 respectively, thus completing the preparation.

Compared to the preparation performed by using the dissolving and mixing unit in Embodiment 1, the preparation performed by using the dissolving and mixing unit in Embodiment 2 is different in: the step (ii) when a plurality of vials are placed on the bottle-containing module 49.

The step (ii) when the dissolving and mixing unit of Embodiment 2 is used for the preparation is as follows.

After the longitudinal drive motor 13 drives the vial to move downwards in order to separate the piercer 38 from the vial, the rotary motor 48 drives the first receiving rod 53 and the bottle-containing module 49 to rotate, so that the second vial on the bottle-containing module 49 is rotated to correspond longitudinally to the piercer 38; then, the longitudinal drive motor 13 drives the first receiving frame 50 to move longitudinally upwards, so that the piercer 38 pierces the rubber stopper of the second vial; subsequently, the medicine in the second vial is dissolved and transferred to the infusion container 41 according to the above-mentioned dissolving and mixing procedure.

The above step (ii) is repeated until medicines in all vials are pumped into the infusion container 41, at which point the dissolving and mixing process is complete.

Example 3: Preparation of Liquid Medicine Bottled in Vial

The preparation performed by using the dissolving and mixing unit shown in Embodiment 1 is as follows.

Firstly, the infusion container 41 is positioned and secured in the second bottle-containing module 14, and the second bottle-containing module 14 is assembled and mounted on the second receiving frame 18. The vial is positioned and secured in the first bottle-containing module 7, and the first bottle-containing module 7 is assembled and mounted on the first receiving rods 9 and 10 of the first receiving frame 8.

Next, the longitudinal drive motor 13 drives the supporting platform 22 (and therefore the first bottle-containing module 7) to move longitudinally upwards, so that the piercer 38 of the dissolving and mixing device 37 pierces the rubber stopper of the vial, and any one piercer is inserted as deep as possible towards the bottom of the vial, so that the medicine solution may be transferred to the infusion container 41 as fully as possible during the dissolving and mixing process; subsequently or simultaneously, the longitudinal drive motor 15 may drive the second receiving frame 18 to move longitudinally upwards, and drive the infusion container 41 to move longitudinally so that the piercer 39 of the dissolving and mixing device 37 pierces the rubber stopper of the infusion container 41.

Then, peristaltic pumps 3 and 4 are operated to pump the medicine solution in the vial completely into the infusion container 41.

(i) If only one vial 47 is placed on the first bottle-containing module 7, the dissolving and mixing process would be complete at this point. The longitudinal drive motor 13 drives the first receiving frame 8 to move downwards, and the longitudinal drive motor 15 drives the second receiving frame 18 to move reversely in the longitudinal direction (downwardly displace), so that the piercers 38 and 39 of the dissolving and mixing device are separated from the vial 47 and the infusion container 41 respectively, thus completing the preparation.

(ii) If a plurality of vials are placed on the first bottle-containing module 7, the longitudinal drive motor 13 drives the first bottle-containing module 7 to move downwards in order to separate the piercer 38 from the vial; then, the transverse drive motor 12 drives the first receiving frame 8 to move transversely so as to move the first bottle-containing module 7 transversely until the second vial corresponds longitudinally to the piercer 38. Then, the longitudinal drive motor 13 drives the supporting platform 22 to move longitudinally upwards, so that the piercer 38 pierces the rubber stopper of the second vial, and subsequently the peristaltic pumps 3 and 4 are initiated to pump the medicine solution in the vial completely into the infusion container.

The step (ii) described above is repeated until the medicines in all vials are dissolved and transferred to the infusion container 41, at which point the dissolving and mixing process is complete.

After the dissolving and mixing process is complete, the longitudinal drive motor 13 drives the first receiving frame 8 to move downwards, and the longitudinal drive motor 15 drives the second receiving frame 18 to move downwards, so that the piercers 38 and 39 of the dissolving and mixing device are separated from the vial and the infusion container 41 respectively, thus completing the preparation.

Compared to the preparation performed by using the dissolving and mixing unit in Embodiment 1, the preparation performed by using the dissolving and mixing unit in Embodiment 2 is different in: the step (ii) when a plurality of vials are placed on the bottle-containing module 49.

When the dissolving and mixing unit of Embodiment 2 is used for preparation, step (ii) is as follows.

After the longitudinal drive motor 13 drives the vials to move downwards in order to separate the piercer 38 from the vials, the rotary motor 48 drives the first receiving rod 53 and the bottle-containing module 49 to rotate, so that the second vial on the bottle-containing module 49 is rotated to correspond longitudinally to the piercer 38; then, the longitudinal drive motor 13 drives the first receiving frame 50 to move longitudinally upwards, so that the piercer 38 pierces the rubber stopper of the second vial; subsequently, the peristaltic pumps 3 and 4 are initiated to pump the medicine solution in the vial completely into the infusion container.

The step (ii) described above is repeated until the medicines in all vials are pumped into the infusion container 41, at which point the dissolving and mixing process is complete.

Example 4: Simultaneous Preparation of Medicines in Both Vial and Ampoule Bottles The preparation performed by using the dissolving and mixing unit shown in Embodiment 1 is as follows.

Firstly, the infusion container 41 is positioned and secured in the second bottle-containing module 14, and the second bottle-containing module 14 is assembled and mounted on the second receiving frame 18. The ampoule bottle and the vial are positioned and secured into the first bottle-containing module 7, and the first bottle-containing module 7 is assembled and mounted on the first receiving rods 9 and 10 of the first receiving frame 8; at this point, the opening of the ampoule bottle is pointing upward.

Then, the dissolving and mixing procedure of the ampoule bottled medicine is carried out according to Example 1, so that the dissolving and mixing process of medicines in all ampoule bottles in the first bottle-containing module 7 is first complete.

Subsequently, the dissolving and mixing procedure of medicines in vials is carried out according to Example 2 or Example 3, so that the dissolving and mixing process of the remaining medicines in vials in the first bottle-containing module 7 is complete.

After the dissolving and mixing process is finished, the longitudinal drive motor 13 drives the first receiving frame 8 to move downward, and the longitudinal drive motor 15 drives the second receiving frame 18 to move downward, so that the piercers 38 and 39 of the dissolving and mixing device are separated from the vial and the infusion container 41 respectively, thus completing the preparation.

Of course, in the dissolving and mixing process, the dissolving and mixing procedure of medicines in vials may be carried out firstly, and then the dissolving and mixing procedure of medicines in ampoule bottles may be carried out; or the dissolving and mixing procedures of medicines in vials and ampoule bottles may be alternately carried out.

Embodiment 3

The dissolving and mixing unit of the embodiment and the dissolving and mixing unit provided in Embodiment 1 are mainly different in the structure of the movement mechanism and the structure of the dissolving and mixing device.

In the embodiment, the specific structure of the dissolving and mixing device may be any part or parts of those provided in patent application entitled "Dissolving and Mixing Device" (application No. PCT/CN2017/077311) filed by the applicant, and shall not be described in detail in the present application. The dissolving and mixing device comprises a frame and two piercer bases which move relative to the frame.

In the embodiment, the movement mechanism comprises a fourth movement mechanism configured to drive one piercer base to move, and a fifth movement mechanism configured to drive the other piercer base to move. The movement of the piercer bases drives the piercers thereon to move in order to pierce the first medicine container and the second medicine container, or to be separated from the first medicine container and the second medicine container.

The dissolving and mixing unit of the embodiment will be described in detail below with reference to FIGS. 9 to 19.

In particular, in the embodiment, the dissolving and mixing unit comprises a support 102, which is installed on the base 101 and may be driven by a rotary motor 125 to rotate, thereby driving all assemblies secured on the support 102 to rotate, and enabling the medicine container to exhibit desired orientation during the dissolving and mixing process.

The support 102 is provided with a dissolving and mixing device 171, peristaltic pumps 103 and 104, a first bottle-containing module, a second bottle-containing module, a fourth movement mechanism and a fifth movement mechanism.

The dissolving and mixing device 171 may include two dissolving and mixing channels, and the peristaltic pumps 103 and 104 may respectively be configured to squeeze elastic infusion hoses in the two dissolving and mixing channels. Of course, an alternative number of dissolving and mixing channels may be included, such as one or more than three (including three), and the number of the peristaltic pumps is identical to the number of dissolving and mixing channels.

The dissolving and mixing device 171 may be assembled and mounted on the support 102. Optionally, the support 102 is provided with two receiving seats 105 and 106 for securing the dissolving and mixing device 171. The frame of the dissolving and mixing device 171 is provided with snap locks, which may be snap locked with the receiving seats 105 and 106. A snap release mechanism 107 is mounted on the support 102 and configured for controlling the lock or release of the dissolving and mixing device 171. After the dissolving and mixing device 171 is secured by the receiving seats 105 and 106, the dissolving and mixing device 171 is combined with the two peristaltic pumps 103 and 104, and the peristaltic pumps 103 and 104 may drive the elastic infusion hoses in the dissolving and mixing device 171.

Two peristaltic pumps 103 and 104 provide power for fluid flow during the dissolving and mixing process, and the two peristaltic pumps 103 and 104 are mounted in the support 102.

The first bottle-containing module may be a vial-containing module 108 for securing vials, or an ampoule bottle-containing module 109 for securing ampoule bottles.

The vial-containing module 108 may include a plurality of bottle-containing elements for holding a plurality of vials in which medicines are filled. In the embodiment shown in the figures, the bottle-containing elements are elastic clamping mechanisms, and the vial-containing module 108 includes four elastic clamping mechanisms 159-162 to hold four vials 129-132. In future applications, the number of elastic clamping mechanisms may be increased or decreased according to clinical needs.

The ampoule bottle-containing module 109 may include a plurality of bottle-containing elements for holding a plurality of ampoule bottles in which medicines are filled. Optionally, in the embodiment shown in the figures, each bottle-containing element comprises two elastic clamping mechanisms, and the two elastic clamping mechanisms clamp the upper end and the lower end of the ampoule bottle respectively; the ampoule bottle-containing module 109 includes eight elastic clamping mechanisms 163-170 for holding four ampoule bottles 133-136. In future applications, the number of elastic clamping mechanisms may be increased or decreased according to clinical needs.

The second bottle-containing module may be an infusion container-containing module 120 for positioning and securing an infusion container. In the embodiment as shown in the figures, slide grooves 118, 119 and a snap positioning mechanism matched therewith are mounted in the support 102, and the snap positioning mechanism is configured for releasably mounting the infusion container-containing module 120. The infusion container-containing module 120 is configured to position and secure an interface of an infusion container 147 by an elastic clamping mechanism 152.

Optionally, the first bottle-containing module (vial-containing module 108 or ampoule bottle-containing module 109) is located above or below the dissolving and mixing device 171, and the fourth movement mechanism may drive a piercer base and a piercer thereon to move longitudinally in order to pierce the first medicine container on the first bottle-containing module or separate from the first medicine container.

Optionally, the fourth movement mechanism comprises a first needle shifter, a third longitudinal drive module, and a third longitudinal slide rail and a paired third longitudinal slide block. The first needle shifter is connected with the third longitudinal slide block, the third longitudinal slide rail is fixed on the support, the third longitudinal drive module is configured to drive the third longitudinal slide block to move along the third longitudinal slide rail, and the first needle shifter is configured for driving the piercer base to move.

In the embodiment shown in the figures, the first slide rail plate 114 is mounted in the support 102, and both sides of the first slide rail plate 114 are provided with third longitudinal slide rails 137 and 140. The third longitudinal slide blocks 143 and 144 fixed on the first needle shifter 113 are matched with the third longitudinal slide rails 137 and 140 respectively. The third longitudinal drive module is a lifting motor 115, and when driven by the lifting motor 115, the third longitudinal slide blocks 143 and 144 move up or down along the third longitudinal slide rails 137 and 140, and thus driving the first needle shifter 113 to move up and down, so that the piercer on a piercer base may be moved up or down to pierce the vials 129-132 or ampoule bottles 133-136 on the first bottle-containing module.

The first needle shifter 113 has a retractable first lever 173. In order to make the first lever 173 extend out into a needle shifter hole of the piercer base to drive the piercer base to move up and down, the fourth movement mechanism further comprises a first needle shifter drive module that drives the first lever to perform extending or retracting movement.

Optionally, in the embodiment shown in the figures, the first needle shifter drive module comprises a first lever motor 116, and the first lever 173 of the first needle shifter 113 may generate corresponding forward extending or backward retracting movement when driven by the first lever motor 116 which is connected with the first lever 173. When moving forward, the first lever 173 extends out and may extend into the needle shifter hole of the piercer base, and after extending, when the lifting motor 115 drives the first needle shifter 113 to move up and down, the piercer base and the piercer thereon may be driven to move up and down. When the first lever 173 retracts and moves away from the needle shifter hole of the piercer base, the first needle shifter 113 separates from the dissolving and mixing device 171.

Optionally, the second bottle-containing module (infusion container-containing module 120) is located above or below the dissolving and mixing device 171, and the fifth movement mechanism may drive the other piercer base and the piercer thereon to move longitudinally in order to pierce the second medicine container on the second bottle-containing module or separate from the second medicine container.

Optionally, the fifth movement mechanism comprises a second needle shifter, a fourth longitudinal drive module, a fourth longitudinal slide rail and a fourth longitudinal slide block which are matched with each other. The second needle shifter is connected with the fourth longitudinal slide block, the fourth longitudinal slide rail is secured on the support, the fourth longitudinal drive module is configured to drive the fourth longitudinal slide block to move along the fourth longitudinal slide rail, and the second needle shifter is configured for driving the other piercer base to move.

In the embodiment shown in the figures, a second slide rail plate 122 is mounted in the support 102, and fourth longitudinal slide rails 148 and 149 are provided on the second slide rail plate 122. The fourth longitudinal slide blocks 150 and 151 are provided on the second needle shifter 121, and the fourth longitudinal slide blocks 150 and 151 are matched with the fourth longitudinal slide rails 148 and 149 respectively. The fourth longitudinal drive module is a lifting motor 123, when driven by the lifting motor 123, the fourth longitudinal slide blocks 150 and 151 may move up and down along the fourth longitudinal slide rails 148 and 149, and drive the second needle shifter 121 to move up and down, which in turn may drive the piercer on the other piercer base to move up and down in order to pierce the infusion container 147 on the second bottle-containing module.

The second needle shifter 121 has a retractable second lever 174. In order to make the second lever 174 extend out and into the needle shifter hole of the other piercer base to drive the other piercer base to move up and down, the fifth movement mechanism further includes a second needle shifter drive module that drives the second lever to perform extending or retracting movement.

Optionally, in the embodiment shown in the figures, the second needle shifter drive module comprises a second lever motor 124, and the second lever 174 of the second needle shifter 121 may generate corresponding forward extending or backward retracting movement when driven by the second lever motor 124 which is connected with the second lever 174. When moving forward, the second lever 174 may extend out into the needle shifter hole of the other piercer base, and when done extending, the lifting motor 123 drives the second needle shifter 121 to move up and down, the other piercer base and the piercer thereon may be driven to move up and down. When the second lever 174 retracts and moves away from the needle shifter hole of the other piercer base, the second needle shifter 121 separates from the dissolving and mixing device 171.

Optionally, in order to enable each of the first medicine containers (vials or ampoule bottles) transversely and linearly arranged on the first bottle-containing module (the vial-containing module 108 or the ampoule bottle-containing module 109) to be pierced by a piercer for dissolving and mixing medicines, the movement mechanism further comprises a sixth movement mechanism, the sixth movement mechanism is configured to drive the first bottle-containing module to move transversely, so that each vial or ampoule bottle may move transversely to correspond longitudinally to a piercer on a piercer base; then the fourth movement mechanism drives the piercer base to move longitudinally, so that the piercer pierces the corresponding vial or ampoule bottle.

Optionally, the sixth movement mechanism comprises a transverse drive module, a transverse slide rail and a transverse slide block which are matched with each other, and a receiving frame. The transverse slide rail is mounted to the support, the transverse slide block is mounted to the receiving frame. The receiving frame is configured for mounting the first bottle-containing module, and the transverse drive module is configured for driving the transverse slide block to move along the transverse slide rail.

In the example shown in the figures, the transverse drive module is a transverse movement motor 126 mounted on the support 102. Two transverse slide rails 141 and 142 are mounted on the support 102, and two transverse slide blocks (only one transverse slide block 153 of which is shown in the figures) are provided on the transverse slide plate 111, and the two transverse slide blocks are matched with the two transverse slide rails 141 and 142 respectively. A receiving frame 110 is provided on the transverse slide plate 111, and the receiving frame 110 is provided with receiving rods 127 and 128. The vial-containing module 108 or the ampoule bottle-containing module 109 may be installed on the receiving rods 127 and 128, and may be releasably mounted by locking mechanisms 157 and 158 on the receiving rods 127 and 128.

The transverse movement motor 126 may drive the two transverse slide blocks to move transversely along the transverse slide rails 141 and 142, which in turn drives the receiving frame 110 to slide transversely through the transverse slide plate 111, and which may still in turn drive the vial-containing module 108 or the ampoule bottle-containing module 109 to move transversely, so that each vial on the vial-containing module 108 or each ampoule bottle on the ampoule bottle-containing module 109 can correspond longitudinally to the piercer so as to be pierced.

Optionally, the dissolving and mixing unit may further include a vibration module 117, which may vibrate the first bottle-containing module and may further drive the vial or ampoule bottle held on the first bottle-containing module to vibrate, in order to facilitate dissolving and mixing the medicines.

In the embodiment shown in the figures, the vibration module 117 is a vibration motor mounted on the receiving frame 110, and the vibration module 117 may generate longitudinal vibration, thereby driving the receiving frame 110 to move longitudinally, which in turn drives the vial-containing module 108 or the ampoule bottle-containing module 109 to vibrate, thus facilitating the dissolving of the medicines.

Optionally, in order to facilitate the longitudinal movement of the receiving frame 110 when it is vibrated, longitudinal guide rail and longitudinal slide block may be provided to guide the longitudinal movement of the receiving frame 110.

In the embodiment shown in the figures, the upper end of the receiving frame 110 is connected with a movement control plate 112, on which longitudinal slide blocks 145 and 146 are provided, and longitudinal slide rails 138 and 139 are provided in the middle portion of the first slide rail plate 114. When the vibration module 117 drives the receiving frame 110 and the first bottle-containing module on the receiving frame 110 to vibrate, the movement control plate 112 at the upper end of the receiving frame 110 may be driven to move longitudinally, and thus the longitudinal slide blocks 145 and 146 may be driven to move longitudinally along the longitudinal slide rails 138 and 139.

In order to prevent the piercer from falling out of the first medicine container (vial or ampoule bottle) during vibration, the first needle shifter 113 and the receiving frame 110 are optionally moved longitudinally in synchronization, so that the piercer on the piercer base into which the first lever 173 extends and the first medicine container are moved longitudinally in synchronization. Therefore, the receiving frame 110 and the first needle shifter 113 may move transversely relative to each other so as to adjust the transverse position of the first bottle-containing module, while the receiving frame 110 and the first needle shifter 113 are longitudinally mounted relative to each other so that the first bottle-containing module and the first needle shifter 113 are moved longitudinally in synchronization.

Optionally, in the embodiment shown in the figures, the transverse relative movement and the longitudinal synchronous movement between the receiving frame 110 and the first needle shifter 113 are realized by the movement control plate 112. In particular, a transverse slide guide rail 175 is provided at the upper end of the receiving frame 110, and two sliding parts 176 and 177 are provided on the movement control plate 112. The two sliding parts 176 and 177 are placed in an up-down direction. The transverse slide guide rail 175 is located between the two sliding parts 176 and 177, and the two sliding parts 176 and 177 contact with an upper surface and a lower surface of the transverse slide guide rail 175 respectively, so that the receiving frame 110 and the movement control plate 112 are oriented longitudinally relative to each other. The two sliding parts 176 and 177 may slide transversely along the transverse slide guide rail 175, and the receiving frame 110 and the movement control plate 112 may move transversely relative to each other. The lifting motor 115 is mounted on the movement control plate 112. Optionally, the two sliding parts 176 and 177 may be bearings. Optionally, the sliding parts may be configured as one sliding part, for example, the sliding part is a slide block which is provided with a slide groove, and the slide block is matched with the transverse slide guide rail 175 to allow sliding. Alternatively, the sliding part may be of other structures which may be matched with the transverse slide guide rail 175 to make sliding possible.

When it is needed to pierce the first medicine container on the first bottle-containing module, the lifting motor 115 drives the third longitudinal slide blocks 143 and 144 to move up and down along the third longitudinal slide rails 137 and 140. The first needle shifter 113 is driven to move up and down, and thus the piercer on the piercer base is driven to move up and down, in order to pierce any of the vials 129-132 or ampoule bottles 133-136 on the first bottle-containing module. When it is needed to transversely move the first bottle-containing module, the transverse movement motor 126 may drive the two transverse slide blocks to move transversely along the transverse slide rails 141 and 142, and thus the receiving frame 110 and the first bottle-containing module thereon are driven to slide transversely by the transverse slide plate 111. When it is needed to vibrate the first bottle-containing module, the vibration module 117 drives the receiving frame 110 and the first bottle-containing module on the receiving frame 110 to vibrate, the movement control plate 112 at the upper end of the receiving frame 110 is driven to move longitudinally, so that the longitudinal slide blocks 145 and 146 move longitudinally along the longitudinal slide rails 138 and 139, and simultaneously the first needle shifter 113 is driven to move longitudinally by the longitudinal moving lifting motor 115 mounted on the movement control plate 112.

Through the movement control plate 112, when performing longitudinal movement, the receiving frame 110 is locked by the movement control plate 112, and performs synchronous longitudinal movement with the first needle shifter 113. The receiving frame 110 is not locked by the movement control plate 112 when performing transverse movement when driven by the transverse slide plate 111, so that the first needle shifter 113 does not make synchronous transverse movement with the receiving frame 110.

The dissolving and mixing method performed by using the dissolving and mixing unit of the embodiment is substantially identical to the dissolving and mixing method performed by using the dissolving and mixing unit of Embodiment 1 or Embodiment 2, except that when the dissolving and mixing unit of Embodiment 1 or Embodiment 2 is used for dissolving and mixing medicines, the first bottle-containing module and the second bottle-containing module are driven to move by the movement mechanisms in order to realize the piercers piercing into the first bottle-containing module and the second bottle-containing module, and in order to realize separation of the piercers from the first and second bottle-containing modules; while in the embodiment, the movement mechanism drives the first needle shifter and the second needle shifter to move, which in turn drives the piercers on the two piercer bases to move, in order to realize the piercers piercing into the first bottle-containing module and the second bottle-containing module and the separation of the piercers from the first bottle-containing module and the second bottle-containing module.

It should be noted that in the above-mentioned three embodiments of the present application, when the first bottle-containing module comprises a plurality of bottle-containing elements, the first medicine containers in different bottle-containing elements are pierced for dissolving and mixing medicines by moving the first bottle-containing module. Of course, the piercers may be moved by moving the piercer bases to pierce the first medicine containers in different bottle-containing elements for dissolving and mixing medicines.

It should be noted that the movement of various components in the dissolving and mixing unit of the embodiments of the present application may be controlled by an automatic dissolving and mixing system.

Various embodiments and examples of dissolving and mixing medicines described above indicate that, the dissolving and mixing unit can perform quick dissolving and mixing of medicines, and can realize automatic dissolving and mixing, it has the capability of independently completing the task of dissolving and mixing of the medicines called out in a doctor's prescription, and can realize fast preparation of the medicines. There is no need for medical staff to contact the medicines and perform multiple piercings of the rubber stoppers of the infusion containers and the vials during the preparation of the medicines, thus effectively mitigating contaminations from detached rubber stoppers granules, external particles and microorganisms during the preparation of the medicines, thereby minimizing the spatter and volatilization of the medicines as much as possible during the preparation of the medicines, effectively reducing the harm of the medicines to the medical staff during the preparation of the medicines, minimizing the exposure of the medicines and the secondary contamination of the medicines, improving the infusion safety, significantly reducing the labor intensity for the medical staff while protecting the health of the medical staff and patients, and bringing considerable benefits to the society and the patients.

The present application also provides a dissolving and mixing system, which comprises the dissolving and mixing unit described in any one or more of several embodiments above.

In the description of this application, the term "a plurality of" refers to two or more than two.

The above disclosure is intended to be illustrative rather than exhaustive. For those skilled in the art, the specification will imply many variations and alternatives. All such alternatives and variations are intended to be included within the scope of the present claims. Those skilled in the art will recognize other equivalents of the embodiments described herein, and these equivalents are also intended to be encompassed by the present claims.

The description of alternative embodiments of the present application has been completed herein. Those skilled in the art can realize that the embodiments described herein are merely used to illustrate the present application, in which the components or the structure of the dissolving and mixing device can be modified, equivalent modifications and improvements made on the basis of the technical schemes of the present application should not be excluded from the protection scope of the present application.

INDUSTRIAL APPLICABILITY

According to the embodiments of the present application, the efficiency of dissolving and mixing medicines is improved, and the labor intensity for medical staff is significantly reduced.

There is no need for the medical staff to contact the medicines, or perform the multiple piercings, thus effectively reducing the harm of medicines to the medical staff during the dissolving and mixing process, reducing exposure and secondary contamination of the medicines, improving safety of the infusion and being advantageous to protect the health of the medical staff and the patients.

What we claim is:

1. A dissolving and mixing unit for automatically dissolving and mixing medicines, comprising:

a support;

a dissolving and mixing device mounted on the support and comprising two piercer bases and at least one dissolving and mixing channel, wherein each dissolving and mixing channel comprises two piercers and an elastic infusion hose connecting the two piercers, and the two piercers of each dissolving and mixing channel are mounted respectively on the two piercer bases;

a peristaltic pump mounted on the support and configured to squeeze the elastic infusion hose;

a first bottle-containing module mounted on the support and configured to hold a first medicine container;

a second bottle-containing module mounted on the support and configured to hold a second medicine container;

a movement mechanism configured to drive at least one of the first bottle-containing module and one piercer base to move, so that the piercer on the piercer base pierces the first medicine container or separates from the first medicine container; and configured to drive at least one of the second bottle-containing module and the other piercer base to move, so that the piercer on the other piercer base pierces the second medicine container or separates from the second medicine container;

wherein the first bottle-containing module comprises a plurality of bottle-containing elements, each of the plurality of bottle-containing elements being configured to secure the first medicine container; and wherein the movement mechanism comprises a horizontal movement mechanism configured to drive the first bottle-containing module or the one piercer base to move horizontally, so that each of the plurality of bottle-containing elements corresponds to the piercer on the one piercer base.

2. The dissolving and mixing unit of claim 1, wherein said movement mechanism further comprises a first movement mechanism configured to drive the first bottle-containing module to move, and a second movement mechanism configured to drive the second bottle-containing module to move.

3. The dissolving and mixing unit of claim 2, wherein said first bottle-containing module is located above or below the dissolving and mixing device, and the first movement mechanism comprises a first longitudinal drive module, a first receiving frame, a first longitudinal slide rail and a first longitudinal slide block which are matched with each other;

wherein the first longitudinal slide block is mounted on the first receiving frame, the first longitudinal slide rail is mounted on the support, the first bottle-containing module is mounted on the first receiving frame, and the first longitudinal drive module is configured to drive the first longitudinal slide block to move along the first longitudinal slide rail.

4. The dissolving and mixing unit of claim 1, wherein said plurality of bottle-containing elements are linearly arranged along a horizontal direction, and the horizontal movement mechanism comprises: a transverse drive module, a supporting platform, a transverse slide rail and a transverse slide block which are matched with each other, and wherein the supporting platform is mounted on the first longitudinal slide block, the transverse slide rail is mounted on the supporting platform, the transverse slide block is mounted on the first receiving frame, and the transverse drive module is configured to drive the transverse slide block to move along the transverse slide rail; or said plurality of bottle-containing elements are circumferentially arranged along a horizontal direction, and the horizontal movement mechanism comprises a first rotary drive module and a first receiving rod, wherein the first bottle-containing module is mounted on the first receiving rod, the first receiving rod is rotationally connected to the first receiving frame, and the first rotary drive module is configured to drive the first receiving rod to rotate.

5. The dissolving and mixing unit of claim 3, wherein the second movement mechanism comprises a second longitudinal drive module, a second receiving frame, a second longitudinal slide rail and a paired second longitudinal slide block, wherein the second longitudinal slide block is mounted on the second receiving frame, the second longitudinal slide rail is mounted on the support, the second bottle-containing module is mounted on the second receiving frame, and the second longitudinal drive module is configured to drive the second longitudinal slide block to move along the second longitudinal slide rail.

6. The dissolving and mixing unit of claim 2, further comprising: a vibration module configured to drive the first bottle-containing module to vibrate.

7. The dissolving and mixing unit of claim 3, wherein the movement mechanism comprises a movement mechanism configured to drive the one piercer base to move, and a movement mechanism configured to drive the other piercer base to move.

8. The dissolving and mixing unit of claim 7, wherein the movement mechanism configured to drive the one piercer base to move comprises a first needle shifter, a third longitudinal drive module, a third longitudinal slide rail and a paired third longitudinal slide block;

wherein the first needle shifter is connected with the third longitudinal slide block, the third longitudinal slide rail is mounted on the support, the third longitudinal drive module is configured to drive the third longitudinal slide block to move along the third longitudinal slide rail, and the first needle shifter is configured for driving the one piercer base to move.

9. The dissolving and mixing unit of claim 8, wherein the movement mechanism configured to drive the one piercer base to move further comprises a first needle shifter drive module;

wherein the first needle shifter has a retractable first lever, and the first needle shifter drive module drives the first lever to perform extending or retracting movement.

10. The dissolving and mixing unit of claim 7, wherein the movement mechanism configured to drive the other piercer base to move comprises a second needle shifter, a fourth longitudinal drive module, a fourth longitudinal slide rail and a matching fourth longitudinal slide block;

wherein the second needle shifter is connected with the fourth longitudinal slide block, the fourth longitudinal slide rail is mounted on the support, the fourth longitudinal drive module is configured to drive the fourth longitudinal slide block to move along the fourth longitudinal slide rail, and the second needle shifter is configured for driving the other piercer base to move.

11. The dissolving and mixing unit of claim 10, wherein the movement mechanism configured to drive the other piercer base to move further comprises a second needle shifter drive module;

wherein the second needle shifter has a retractable second lever, and the second needle shifter drive module drives the second lever to perform extending or retracting movement.

12. The dissolving and mixing unit of claim 7, further comprising: a vibration module configured to drive the first bottle-containing module to vibrate.

13. The dissolving and mixing unit of claim 8, further comprising: a longitudinal vibration module capable of driving the first bottle-containing module to longitudinally vibrate;

wherein the first bottle-containing module and the first needle shifter are capable of moving transversely relative to each other, while the first bottle-containing module and the first needle shifter are longitudinally stationary relative to each other.

14. The dissolving and mixing unit of claim 13, wherein the first bottle-containing module is mounted on the first receiving frame, the first receiving frame is provided with a transverse slide guide rail, a movement control plate is provided with a sliding part which matches the transverse slide guide rail and is capable of sliding transversely along the transverse slide guide rail, and the third longitudinal drive module is mounted on the movement control plate.

15. The dissolving and mixing unit of claim 1, further comprising: a base, wherein the support is mounted on the base and is rotatable relative to the base; and a second rotary drive module configured to drive the support to rotate.

16. The dissolving and mixing unit of claim 1, wherein one of a frame of the dissolving and mixing device and the support is provided with a snap lock, and the other of the frame and the support is provided with a receiving seat, and the snap lock can engage with the receiving seat;

the other of the frame and the support is provided with a snap release mechanism for separating the snap lock from the receiving seat.

17. An automatic dissolving and mixing system, comprising at least one dissolving and mixing unit of claim 1.

18. A method for dissolving and mixing medicines by using the dissolving and mixing unit of claim 1, comprising the following steps:

holding the first medicine container and the second medicine container in the first bottle-containing module and the second bottle-containing module, respectively;

driving, by the movement mechanism, the first bottle-containing module or the one piercer base to move, so that the piercer on the one piercer base pierces the first medicine container, and driving, by the movement mechanism, the second bottle-containing module or the other piercer base to move, so that the piercer on the other piercer base pierces the second medicine container;

operating the peristaltic pump to dissolve and mix the medicine;

after the dissolving and mixing operation is complete, driving, by the movement mechanism, the first bottle-containing module or the one piercer base to move, so that the piercer on the one piercer base separates from the first medicine container, and driving, by the movement mechanism, the second bottle-containing module or the other piercer base to move, so that the piercer on the other piercer base separates from the second medicine container.

19. A method for dissolving and mixing medicines by using the dissolving and mixing unit of claim 1, wherein the first bottle-containing module comprises a plurality of bottle-containing elements, the method comprises the following steps:

holding a plurality of first medicine containers in the plurality of bottle-containing elements of the first bottle-containing module, and holding the second medicine container in the second bottle-containing module;

driving, by the movement mechanism, the first bottle-containing module or the one piercer base to move, so that the piercer on the one piercer base pierces the first medicine container;

driving, by the movement mechanism, the second bottle-containing module or the other piercer base to move, so that the piercer on the other piercer base pierces the second medicine container;

operating the peristaltic pump to dissolve and mix the medicine;

driving, by the movement mechanism, the first bottle-containing module or the one piercer base to move after the dissolving and mixing operation is complete, so that the piercer on the one piercer base separates from the first medicine container;

repeating the steps of piercing the first medicine container, operating the peristaltic pump to dissolve and mix the medicine, and separating the piercer from the first medicine container, until all of the first medicine containers perform the dissolving and mixing operation of the medicine;

driving, by the movement mechanism, the second bottle-containing module or the other piercer base to move, so that the piercer on the other piercer base separates from the second medicine container.

* * * * *